US011078066B2

(12) United States Patent
Crackel et al.

(10) Patent No.: US 11,078,066 B2
(45) Date of Patent: Aug. 3, 2021

(54) POST-MIX NOZZLE

(71) Applicant: Automatic Bar Controls, Inc., Vacaville, CA (US)

(72) Inventors: Cullen James Crackel, Sacramento, CA (US); Thomas Hecht, Vacaville, CA (US); Silas Veloz, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 16/702,428

(22) Filed: Dec. 3, 2019

(65) Prior Publication Data

US 2020/0180931 A1 Jun. 11, 2020

Related U.S. Application Data

(60) Provisional application No. 62/774,670, filed on Dec. 3, 2018.

(51) Int. Cl.
*B67D 1/00* (2006.01)

(52) U.S. Cl.
CPC ..... *B67D 1/005* (2013.01); *B67D 1/0021* (2013.01)

(58) Field of Classification Search
CPC .... A61M 2005/202; A61M 2005/2407; A61M 2005/3103; A61M 2005/3126; A61M 2005/3154; A61M 2205/581; A61M 5/2459; A61M 5/31536; A61M 5/31541; A61M 5/31548; A61M 5/3155; A61M 5/31551; A61M 5/31553; A61M 5/31555; A61M 5/31561; A61M 5/31585; B67D 1/0021; B67D 1/005
See application file for complete search history.

(56) References Cited

U.S. PATENT DOCUMENTS 4,928,854 A * 5/1990 McCann ..... B67D 1/0044 222/129.1
5,033,651 A * 7/1991 Whigham ..... B67D 1/0051 222/1
5,203,474 A * 4/1993 Haynes ..... B67D 1/0044 222/129.1
5,269,442 A * 12/1993 Vogel ..... B67D 1/0044 222/129.1
5,415,326 A * 5/1995 Durham ..... B67D 1/005 222/129.1
6,047,859 A * 4/2000 Schroeder ..... B67D 1/0043 222/1
6,253,963 B1 * 7/2001 Tachibana ..... B67D 1/0044 222/129.1

(Continued)

*Primary Examiner* — Vishal Pancholi
*Assistant Examiner* — Bob Zadeh
(74) *Attorney, Agent, or Firm* — Kilpatrick Townsend & Stockton LLP

(57) ABSTRACT

Disclosed is a post-mix beverage dispensing nozzle. The dispensing nozzle includes an input fitting, a cap, an insert, and a body. The dispensing nozzle defines a first flow path and a second flow path. The first flow path flows from a first input port offset from a central axis of the dispensing nozzle to a mixing chamber. The second flow path flows from an input port offset from the central axis of the dispensing nozzle to the mixing chamber. At the point of the mixing chamber both the first flow path and second flow path have uniform flow rates in all radial directions around the central axis.

10 Claims, 20 Drawing Sheets

(56) References Cited

U.S. PATENT DOCUMENTS

| | | | | |
|---|---|---|---|---|
| 6,345,729 | B1 * | 2/2002 | Santy, Jr. | B67D 1/0021 222/1 |
| 7,866,509 | B2 * | 1/2011 | Ziesel | B67D 1/0081 222/145.1 |
| 9,434,594 | B2 * | 9/2016 | Kaneko | B67D 1/07 |
| 2004/0245287 | A1 * | 12/2004 | Fox | B67D 1/0085 222/129.1 |
| 2005/0072799 | A1 * | 4/2005 | Stratton | B67D 1/0027 222/129.1 |
| 2017/0233234 | A1 * | 8/2017 | Hecht | B67D 1/0021 222/129.1 |
| 2020/0180931 | A1 * | 6/2020 | Crackel | B67D 1/0021 |

* cited by examiner

POST-MIX NOZZLE

CROSS-REFERENCES TO RELATED APPLICATIONS

The present application claims the benefit of U.S. Provisional Application No. 62/774,670 entitled "POST-MIX NOZZLE," filed on Dec. 3, 2018, the entire contents of which are herein incorporated by reference for all purposes.

BACKGROUND OF THE INVENTION

The present technology relates to post-mix beverage dispensers. Post-mix beverage dispensing refers to mixing a beverage at or near the point of dispensing. The components of the post-mix beverage may be one or more base liquids, for example still water, carbonated water, and flavored water/soda; and one or more additive liquids, for example flavoring syrup or alcohol. Post-mix dispensing is in contrast to pre-mix dispensing wherein the base liquid and additives, for example water and a flavor concentrate, are mixed and stored in a holding tank before being dispensed. An advantage of post-mixing relates to shelf life of the additives, for example flavoring syrup, being longer compared to the mixed beverage.

In post-mixing the base liquid(s) and additive(s) are delivered by separate conduits to a dispenser nozzle, and then mixed while being dispensed through the nozzle. Existing post-mix nozzles result in poor mixing of the base liquid and additives, for example the output stream will have a portion only containing one or the other of the input liquids. For example, when dispensing cola the output stream of the nozzle may have a first portion of just soda water, a second portion that is only cola syrup, and a third portion that is a mix of the soda water and cola syrup. This results in a portion of the mixing occurring in the cup after the beverage is dispensed, which is undesirable as it may lead to inconsistent flavors between sips of the beverage.

Accordingly, there is a need for an apparatus for dispensing post-mix beverages that dispenses a fully mixed beverage.

BRIEF SUMMARY OF THE INVENTION

Disclosed is a post-mix beverage dispensing nozzle. The dispensing nozzle includes an input fitting, a cap, an insert, and a body. The dispensing nozzle defines a first flow path and a second flow path. The first flow path flows from a first input port offset from a central axis of the dispensing nozzle to a mixing chamber. The second flow path flows from an input port offset from the central axis of the dispensing nozzle to the mixing chamber. At the point of the mixing chamber both the first flow path and second flow path have uniform flow rates in all radial directions around the central axis

BRIEF DESCRIPTION OF THE DRAWINGS

Illustrative aspects of the present disclosure are described in detail below with reference to the following drawing figures. It is intended that that embodiments and figures disclosed herein are to be considered illustrative rather than restrictive.

DETAILED DESCRIPTION OF THE INVENTION

Figure 1A:
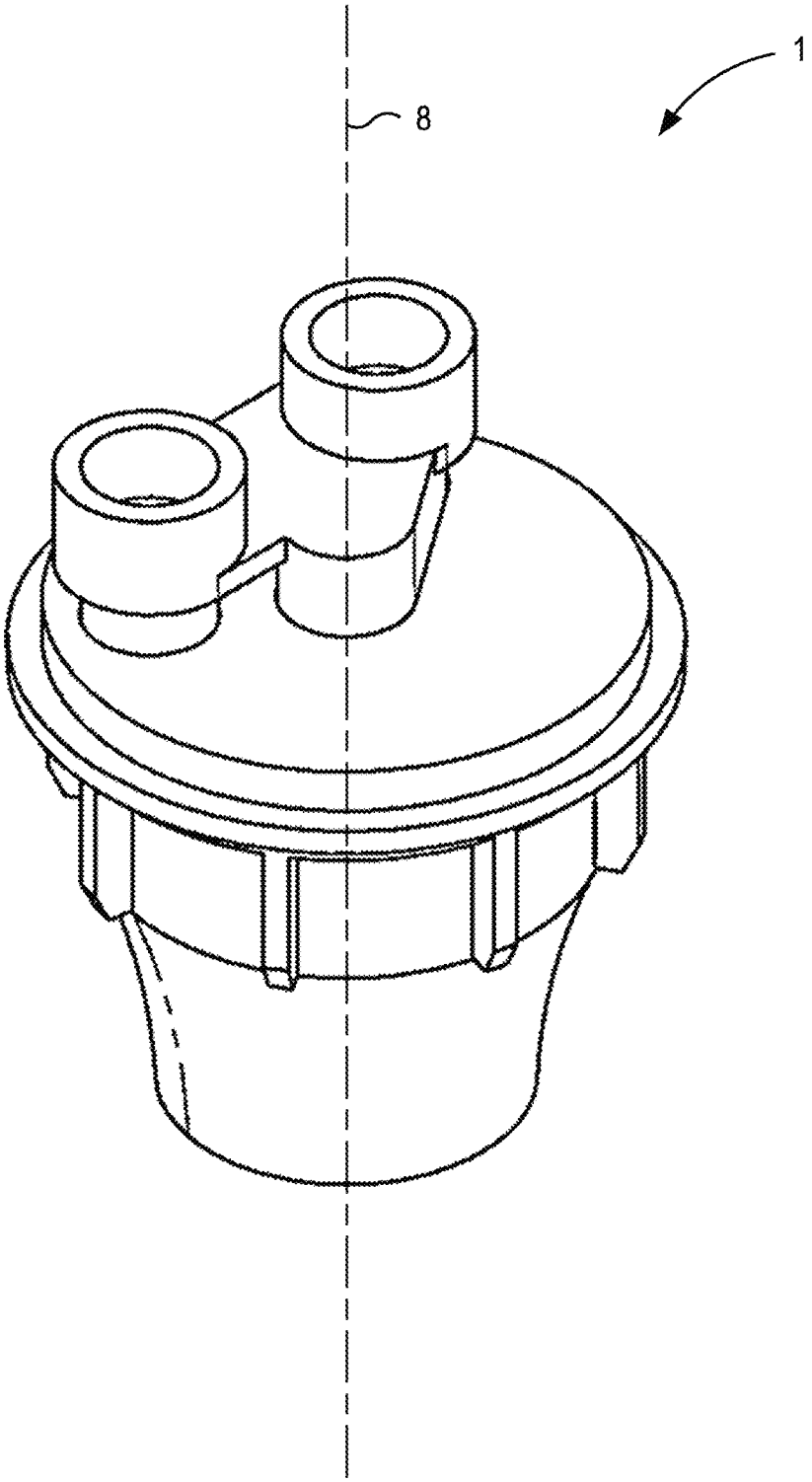
FIG. 1A shows a nozzle assembly according to embodiments of the disclosed technology.
Figure 1B:
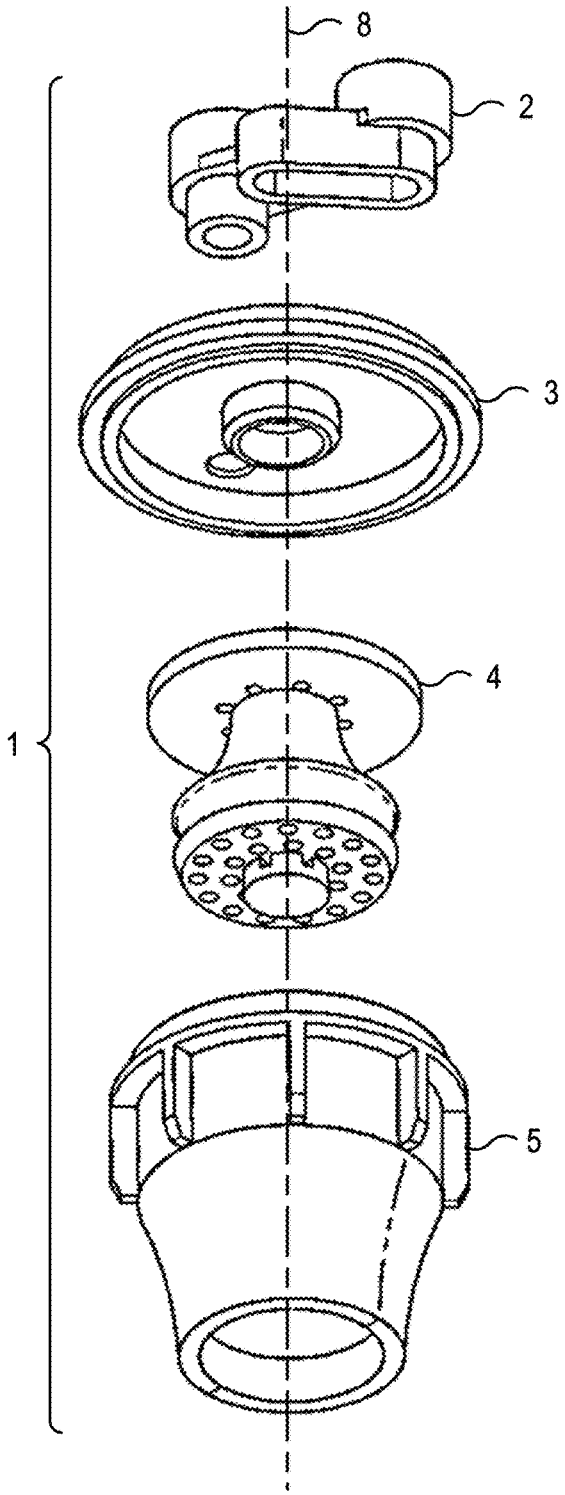
FIGS. 1B and 1C show exploded views of the nozzle assembly of FIG. 1A. according to embodiments of the disclosed technology.
Figure 1C:
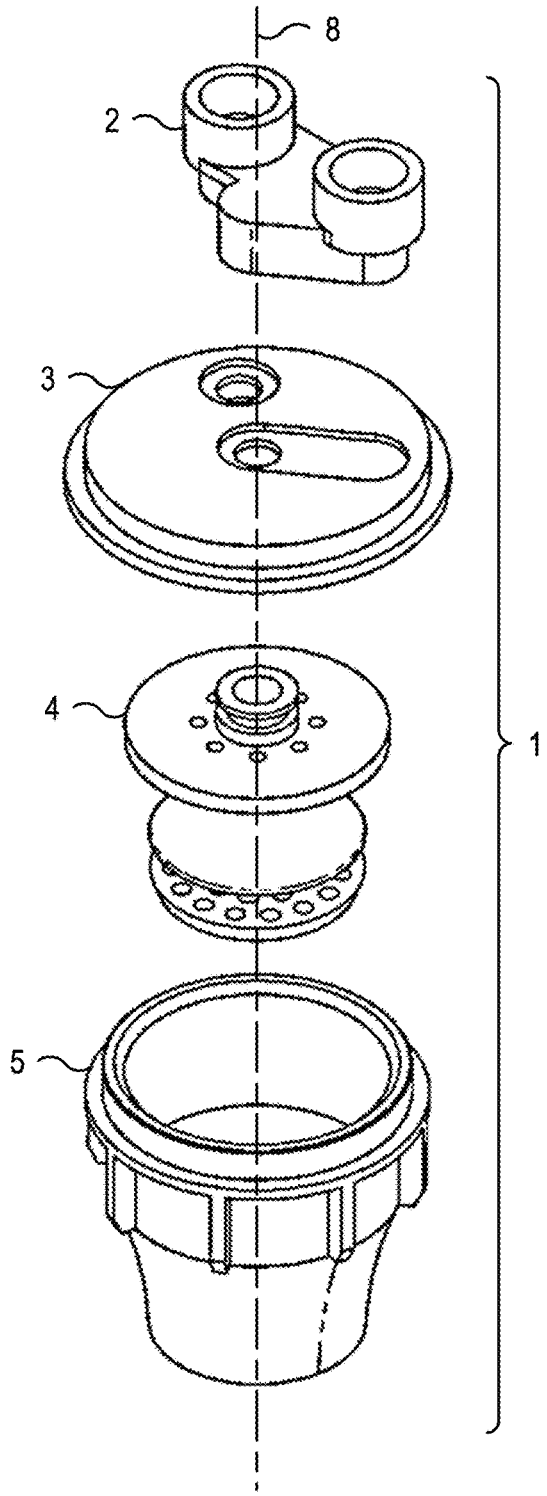

FIG. 1A shows a nozzle assembly 1 in an assembled configuration. As shown in the exploded views of FIGS. 1B and 1C the nozzle assembly 1 comprises a input fitting 2, a cap 3, an insert 4, and a body 5. As shown, the insert 4 is coupled to the cap 3, and the cap 3 is coupled to the body 5 and the insert 4, with the insert 4 positioned within the body 5.

FIGS. 2A-2G show an input fitting 2. The input fitting 2 includes a first input port 6 and a second input port 7. As will be discussed in greater detail below, the first input port 6 and the second input port 7 are radially offset from the central axis 8 of the nozzle assembly 1. As shown, the first input port 6 and the second input port 7 may be circular and are sized and shaped to couple to fluid conduits connected to fluid sources, for example as shown in FIGS. 7A-7F.

Figure 2A:
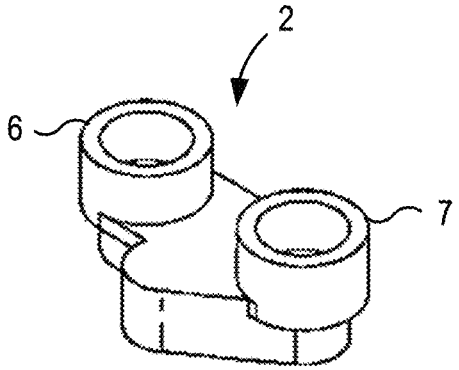
FIGS. 2A-2G show an input fitting according to embodiments of the disclosed technology.
Figure 2B:
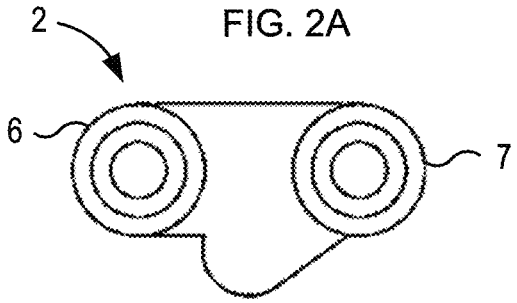
Figure 2C:
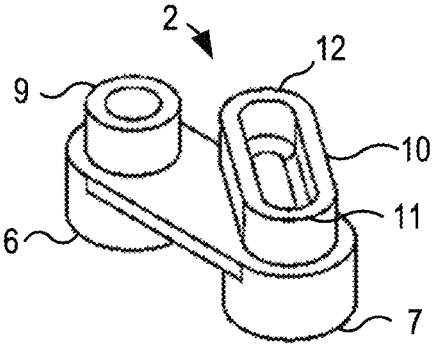
Figure 2D:
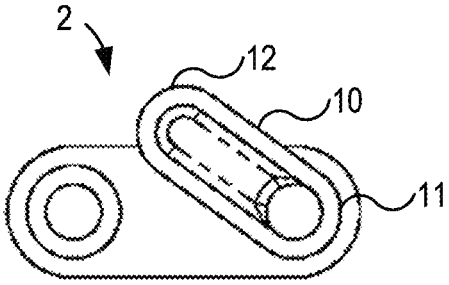
Figure 2E:
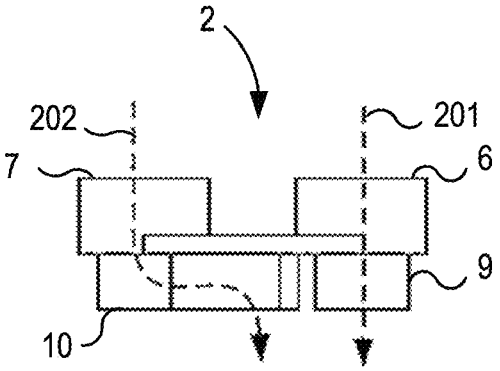
Figure 2F:
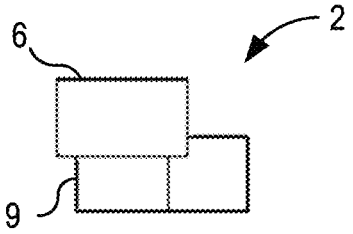
Figure 2G:
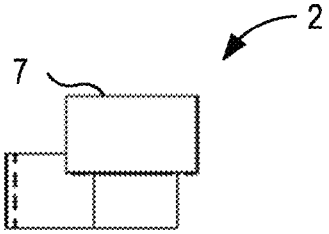

Input fitting 2 further includes a first output port 9. First output port 9 may be circular as shown in FIGS. 2C and 2D. First input port 6 and first output port 9 are coaxial and fluidly connected to define a portion of a first flow path. The portion of the first flow path defined by the first input port 6 and the first output port 9 is generally straight so that a first liquid can flow straight through the input fitting, as indicated by the straight line arrow 201 of FIG. 2E. Input fitting 2 further includes a second output port 10. Second output port 10 may be elongated in shape with circular ends as shown in FIGS. 2C and 2D. A first end 11 of the second output port 10 is aligned with second input port 7. A second end 12 of the second the output port 10 is not aligned with second input port 7, and as will be discussed in greater detail below is positioned so that when the input fitting 2 is coupled to the cap 3 as part of the nozzle assembly 1 the central axis 8 extends through the second end 12 of the second output port 10. The second input port 7 and the second output port 10 are connected to define a portion of a second flow path, along with the cap 3 as will be discussed below. The portion of the second flow path is serpentine in shape from the second input port 7, to the first end 11 of the second output port 10, to the second end 12 of the second output port 10. The portion of the second flow path allows for a second liquid to flow through the input fitting, as indicated by the S shaped arrow 202 of FIG. 2E. In embodiments, the input fitting 2 is formed as a single component, or as two or more components, for example a first component with the first input and output ports, and a second component with the second input port and the second output port.

FIGS. 3A-3E show a cap 3. Cap 3 includes a top surface 13 that defines a portion of an outer surface of the nozzle assembly 1, and a bottom surface 14 that defines a portion of an inner surface of the nozzle assembly 1. Top surface 13 includes a first recess 15 and a second recess 16. First recess 15 is generally circular and is sized and shaped to receive and couple to the first output port 9 of the input fitting 2. The second recess 16 is elongated in shape with rounded ends and is sized and shaped to receive and couple to the second output port 10 of the input fitting 2. The second recess 16 extends from the center of the cap 3, which corresponds to the central axis 8 of the nozzle assembly 1, toward a perimeter of the cap 3. The first recess 15 include a first through hole 17 concentric with the first recess 15. The second recess 16 includes a second through hole 18 at the center of the cap 3. With the input fitting 2 coupled to the cap 3 a portion of the first flow path is defined from the first input port 6 through the first through hole 17, and a portion of the second flow path is defined from the second input port 7 through the second through hole 18. In embodiments, the surface of the second recess defines an inner surface of the second flow path.

Figure 3A:
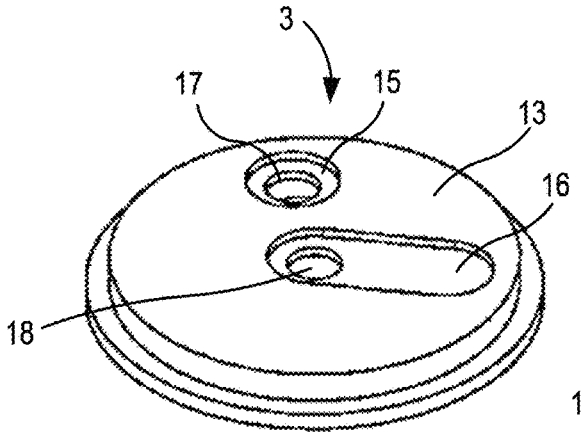
FIGS. 3A-3E show a cap according to embodiments of the disclosed technology.
Figure 3B:
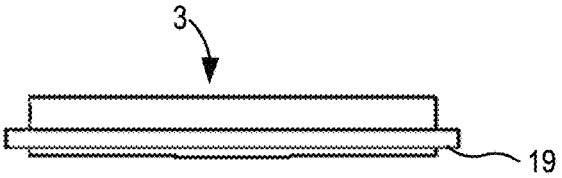
Figure 3D:
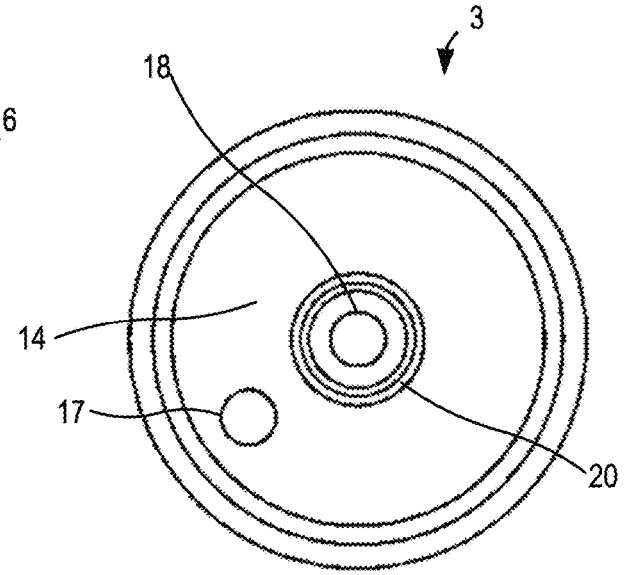
Figure 3C:
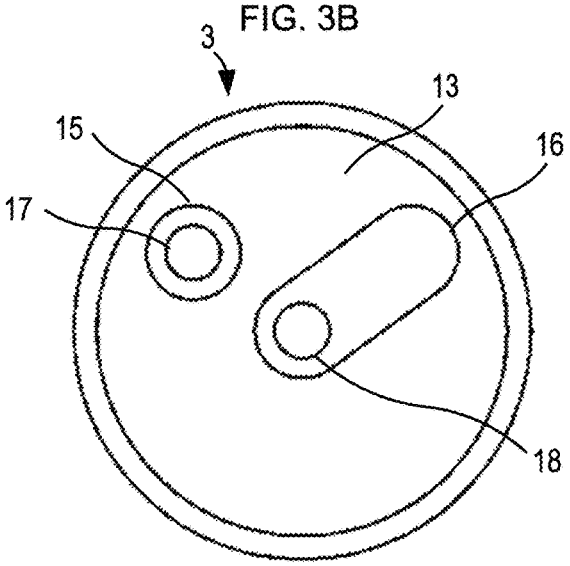
Figure 3E:
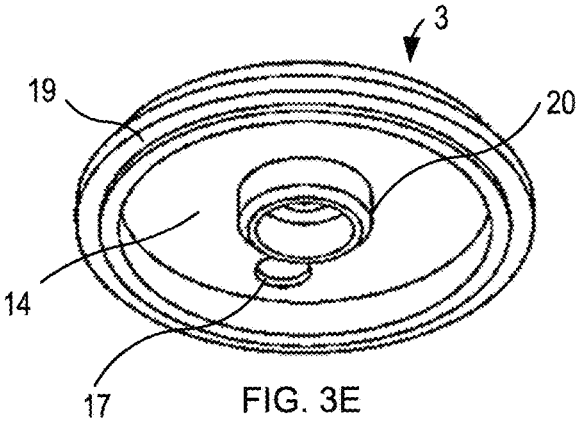

As shown in FIG. 3E, cap 3 further includes a bottom surface 14 surrounded by a flange 19. Extending downwardly from the bottom surface 14 is a coupling ring 20 in the center of the bottom surface 14. Coupling ring 20 surrounds the second through hole 18 and is shaped and sized to couple to the insert 4, as will be discussed in greater detail below.

Figure 4A:
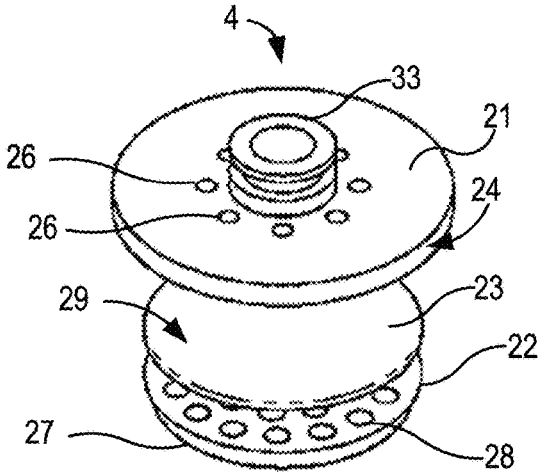
FIGS. 4A-4F show an insert according to embodiments of the disclosed technology.
Figure 4B:
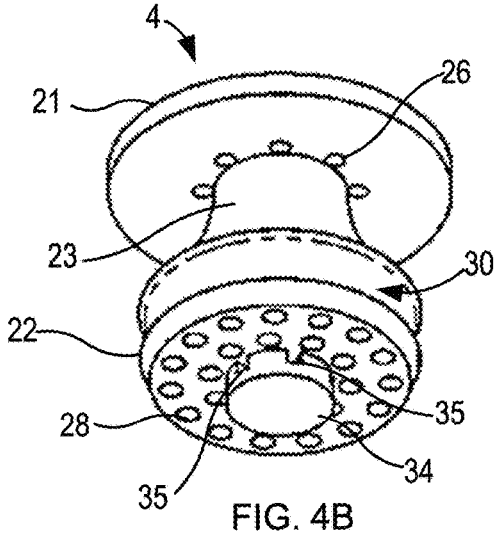
Figure 4C:
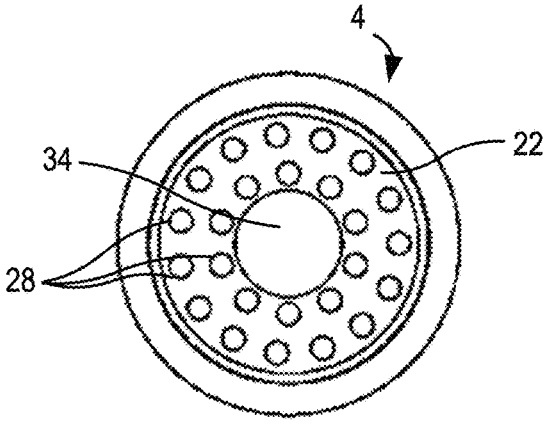
Figure 4D:
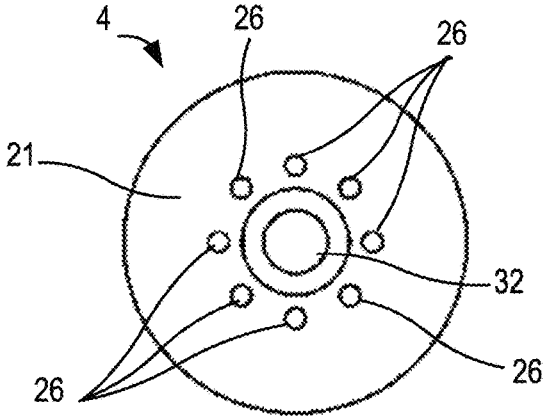

FIGS. 4A-4F show insert 4. As shown in FIG. 4A, insert 4 includes an upper plate 21, a lower plate 22, and a conical portion 23. Upper plate 21 is generally circular with an outer edge 24 shaped and angled to form a flush seal against the inner surface 25 of the body 5. Upper plate 21 further includes a plurality of through holes 26. As shown in FIG. 4D the through holes 26 may be positioned along a single circular pattern, which is around the central axis 8 of the nozzle assembly 1. In the embodiment shown, the through holes 26 of the upper plate 21 include eight equally spaced through holes. However, other numbers and patterns of through holes 26 may be included. In embodiments, the through holes 26 have diameter in the range of 0.05 inches and 0.12 inches, and preferably 0.08 inches.

Figure 4E:
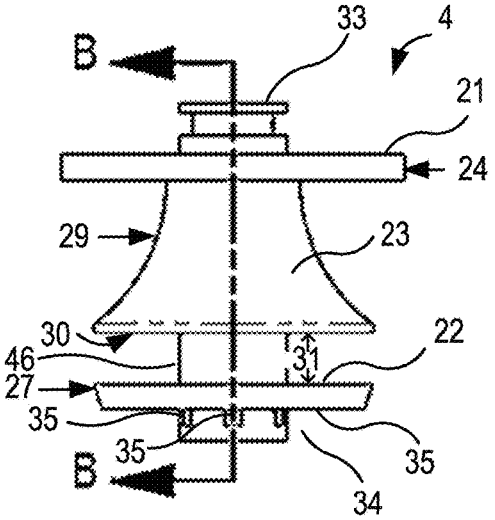
Figure 4F:
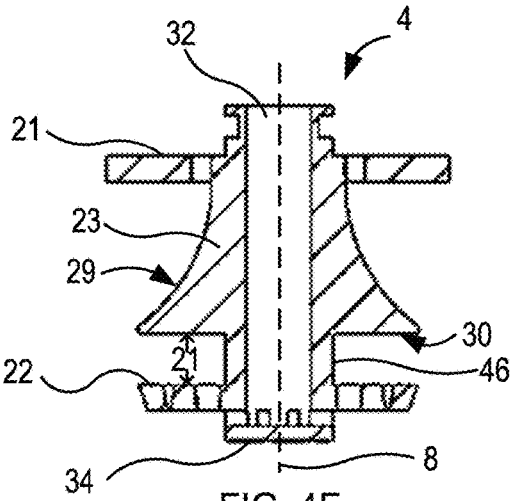

As shown in FIG. 4C, lower plate 22 is generally circular with an outer edge 27 shaped and angled to form a flush seal against the inner surface 25 of the body 5. For example the outer edge 27 of lower plate 22 may be narrower at the bottom and wider at the top, as shown in FIG. 4E. Lower plate 22 further includes a plurality of through holes 28. As shown in FIG. 4C the through holes 28 may be positioned in a double concentric circular pattern. For clarity in FIGS. 4A, 4B, and 4C only a portion of the through holes 28 are indicated with reference numerals and lead lines. In the embodiment shown, the through holes 28 of the lower plate 22 include ten through holes in the inner circle and fifteen through holes in the outer circle each equally spaced in their respective circles. Further, the outer through holes may have the same, a larger, or a smaller diameter than the inner through holes. In embodiments, the through holes 28 may have a diameter between 0.04 and 0.06 inches, and preferably about 0.08 inches. This arrangement of through holes 28 of the lower plate 22 causes substantially uniform flow in all radial directions of fluid exiting the lower plate 22, as will be discussed in greater detail below. In embodiments, the lower plate 22 may have through holes with other diameters and may have through holes with a plurality of different diameters, and/or a different number of through holes, and/or a different number of concentric circles, and/or a different pattern. In embodiments the lower plate 22 has a smaller diameter than the upper plate 21 in order for the insert 4 to be positioned within the body 5 against the tapered inner surface 25 to form a seal.

As shown in FIG. 4E, conical portion 23 include a conical outer surface 29 and a bottom surface 30. The conical outer surface 29 extends from the upper plate 21 to an interface with the bottom surface 30 and may be frustoconical in shape. As shown in FIG. 4E, the conical outer surface 29 may be concave so that the width of the cross-section of the outer surface increases from the upper plate 21 to the bottom surface 30 in a non-linear manner, with the rate of increase in the width increasing toward the bottom surface 30. In other words, the outer surface 29 of the conical portion 23 is concave in a cross-sectional plane parallel to the central axis and may be referred to as "bell shaped". This concave shape has the advantage of gradually decreasing the cross-section of the volume between the insert 4 and the body 5. In embodiments, the conical portion 23 may have a straight side wall profile or a convex sidewall profile.

As shown in FIG. 4E, the bottom surface 30 may be flat and may be separated from and parallel to the lower plate 22. The gap 31 between the bottom surface 30 and the lower plate 22 may range from 0.1 inches to 0.5 inches, and is preferably about 0.2 inches. As shown, the bottom surface 30 overlaps the through holes 28 of the lower plate 22 when viewed from a plane perpendicular to the central axis 8.

The insert 4 further defines a central lumen 32 extending from a coupling 33 at the top of the insert 4 above the upper plate 21, through the upper plate 21, through the conical portion 23, through the lower plate 22 and to an outlet end 34. As shown in FIG. 4A, the central lumen 32 is generally circular in profile. The central lumen 32 is open at the coupling 33. Coupling 33 is shaped and sized to couple with the coupling ring 20 of the cap 3 to form a watertight seal. The outlet end 34 at the bottom of the central lumen 33 defines a plurality of outlets 35. As shown, the outlets 35 may be rectangular in profile and are oriented to direct a fluid stream flowing into the central lumen 32 from the coupling 33 out in a radial pattern in an exit plane perpendicular to the central axis 8. In embodiments, the outlets 35 are square with sides between 0.04 inches and 0.1 inches, and preferably 0.06 inches. The exit plane is substantially parallel to the bottom of the lower plate 22 and as will be discussed below allows for the fluid flowing through the central lumen 32 to mix with the fluid flowing through the through holes 28 of the lower plate 22.

Figure 5A:
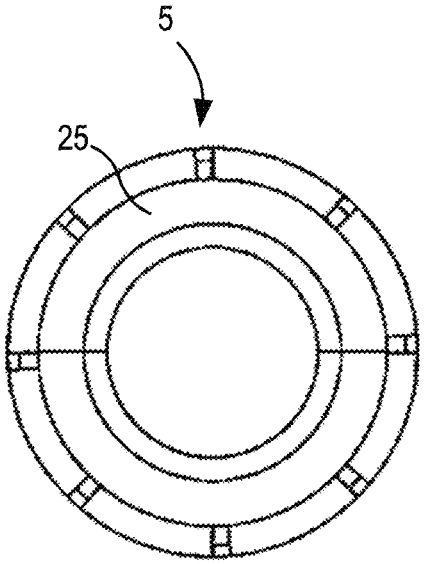
FIGS. 5A-5C show a body according to embodiments of the disclosed technology.
Figure 5B:
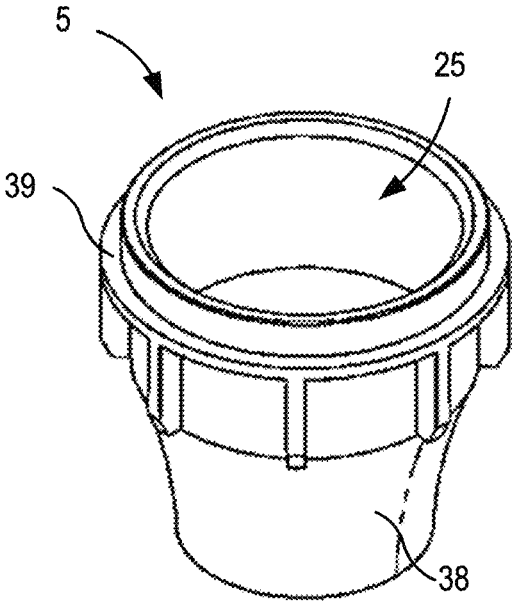
Figure 5C:
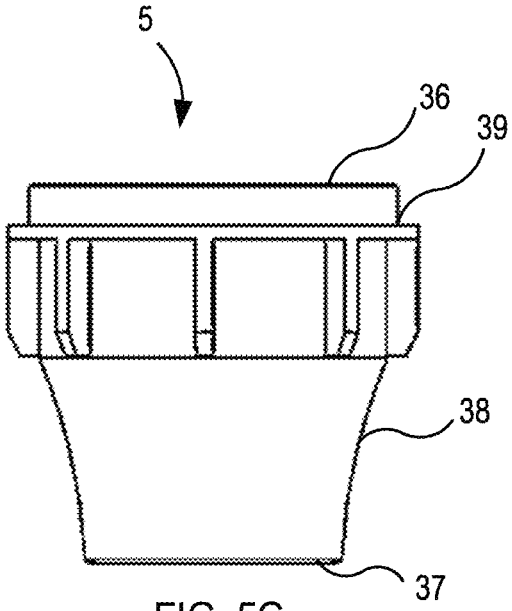

FIGS. 5A-5C show body 5. Body 5 includes a top opening 36 and a bottom opening 37 on opposite ends of the inner surface 25. As shown, top opening 36 may be smaller than bottom opening 37 so that the inner surface 25 tapers from the top to the bottom of the body 5. The taper of the inner surface 25 may be a curved taper. In embodiments the taper may be straight. The taper of the inner surface 25 defines an axial position where the insert 4 will be positioned and form a seal. The diameters of the upper plate 21 and lower plate 22 correspond to the taper of the inner surface 25. The body further comprises an outer surface 38. At the top of the body 5, the outer surface 38 includes a flange 39 sized and shaped to form a seal with the flange 19 of the cap 3. When flange 39 and flange 19 couple and seal the interior of the body 5 and cap 3 define a watertight compartment with through holes 17 and 18 defining inlets and bottom opening 37 defining an outlet.

Figure 6A:
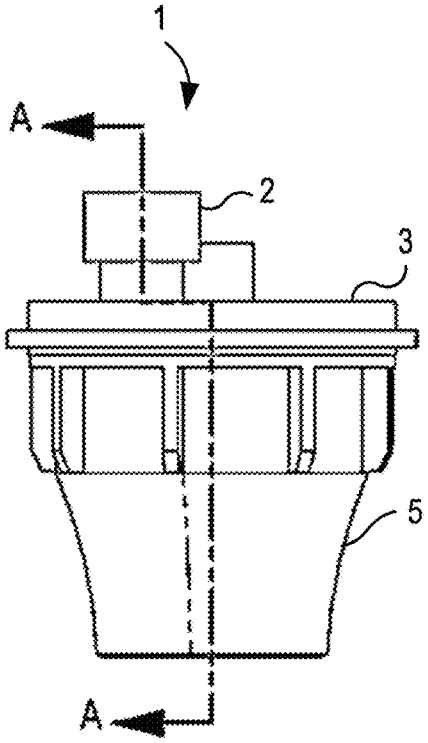
FIGS. 6A-6F show a nozzle assembly according to embodiments of the disclosed technology.
Figure 6B:
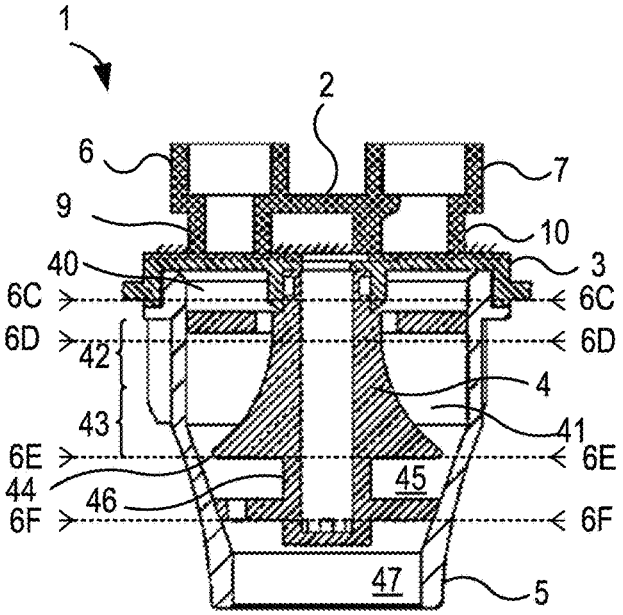
Figure 6C:
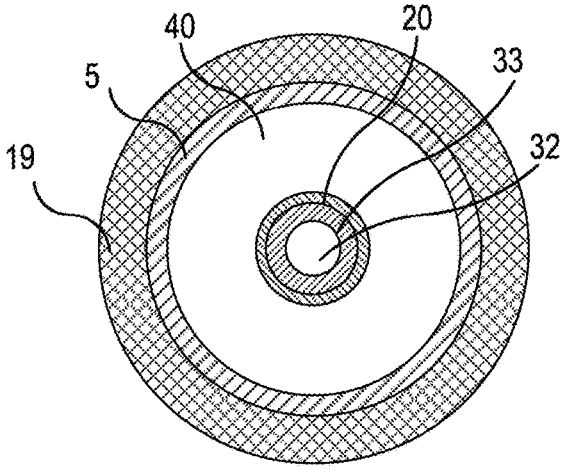
Figure 6D:
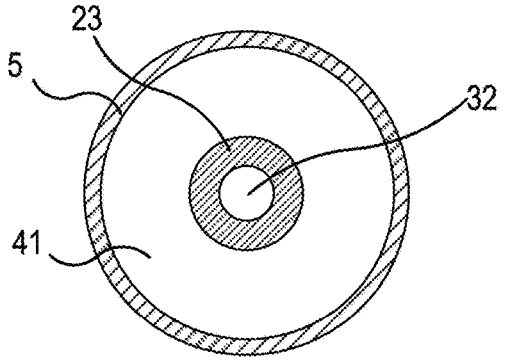

FIGS. 6A-6F show a nozzle assembly 1 including an input fitting 2, cap 3, insert 4, and body 5, as disclosed above. As shown in the cross-section view of FIG. 6B, insert 4 is positioned in the body 5 so that upper plate 21 forms a seal with inner surface 25, and lower plate 22 forms a seal with inner surface 25. Further, as shown in FIG. 6B the taper of inner surface 25 at lower plate 22 prevents insert 4 from being positioned lower in body 5. With this positioning of insert 4, the coupling 33 is located substantially in the plane of the top opening 36 of the body 5 so that when the cap 3 couples to the body 5 the coupling ring 20 couples to and forms a seal with coupling 33.

The nozzle assembly 1 defines two flow paths, a first flow path and a second flow path. The first flow path begins at the first input port 6 of the input fitting 2 and flows parallel to the central axis 8 through the first output port 9, through the first through hole 17 of cap 3, and into an upper chamber 40 defined by the inner surface 25 of the body 5, the cap 3, and the upper plate 21 of the insert 4. As shown in FIG. 6B the outer edge 24 of the upper plate 21 seals with the inner surface 25 of the body 5. Further, as shown in FIG. 6B and the cross-section of FIG. 6C the upper chamber 40 is a toroid in shape with the central lumen 32 in the void/hole of the toroid. When fluid enters the upper chamber 40 from the first input port 6 the fluid substantially occupies the entire volume of the upper chamber 40.

From the upper chamber 40 the first flow path flows through all of the through holes 26 of the upper plate 21 and into a first middle chamber 41. The first middle chamber 41 is defined by the upper plate 22, the inner surface 25 of the body 5, and the conical outer surface 29. As shown in FIG. 6B and the cross-sections of FIGS. 6D and 6E, the first middle chamber 41 is toroid in shape with the central lumen 32 in the void/hole of the toroid. As shown, the upper portion 42 of the first middle chamber 41 has a larger cross sectional area than the bottom portion 43 due to the wider inner surface 25 diameter and smaller conical portion 23 diameter at the upper portion 42 compared to the narrower inner surface 25 diameter and larger conical portion 23 diameter at the bottom portion 43 of the first middle chamber 41. As fluid passes through the first middle chamber 41 the velocity increases due to this reduction in cross-sectional area.

Figure 6E:
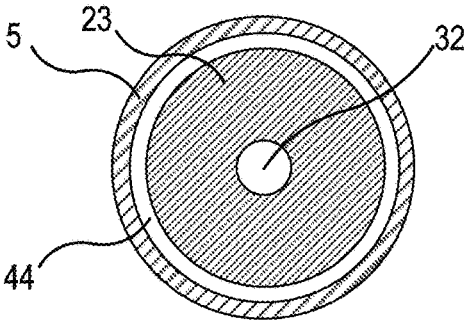
Figure 6F:
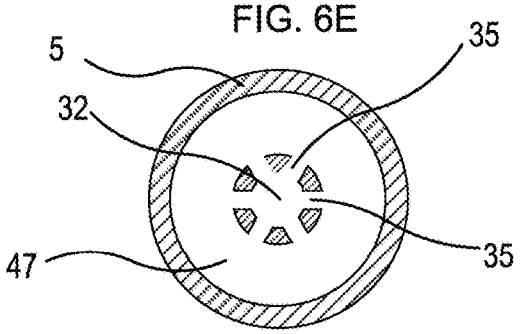
Figure 7A:
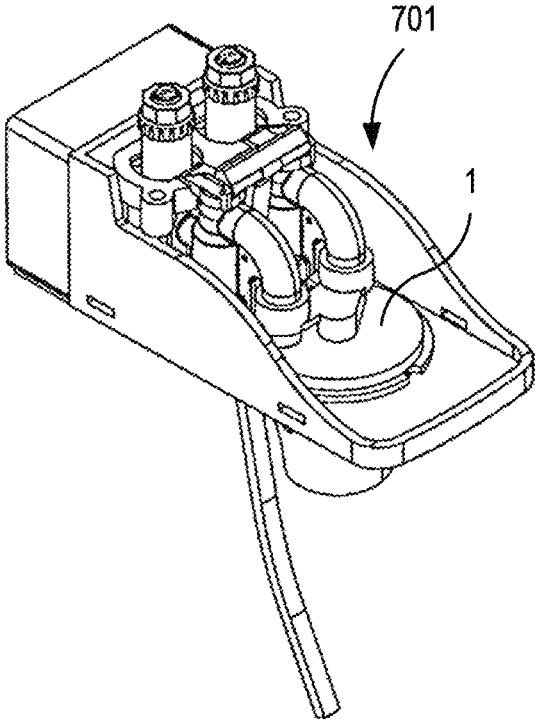
FIGS. 7A-7F show a post-mix beverage dispensing apparatus including a dispensing nozzle of FIG. 1A.
Figure 7B:
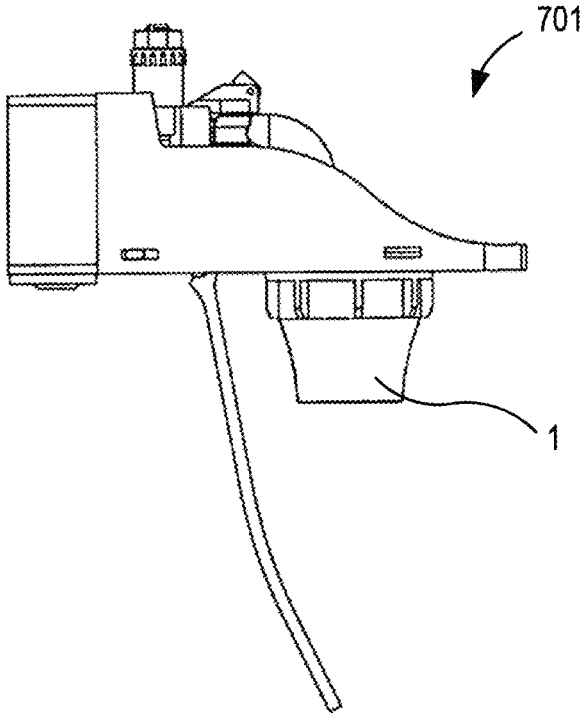
Figure 7C:
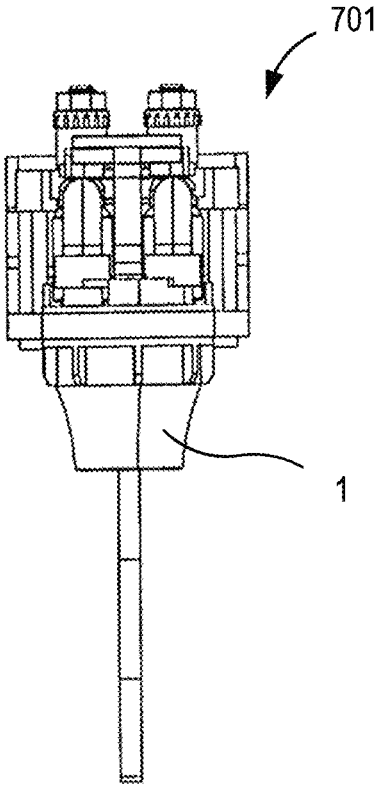
Figure 7D:
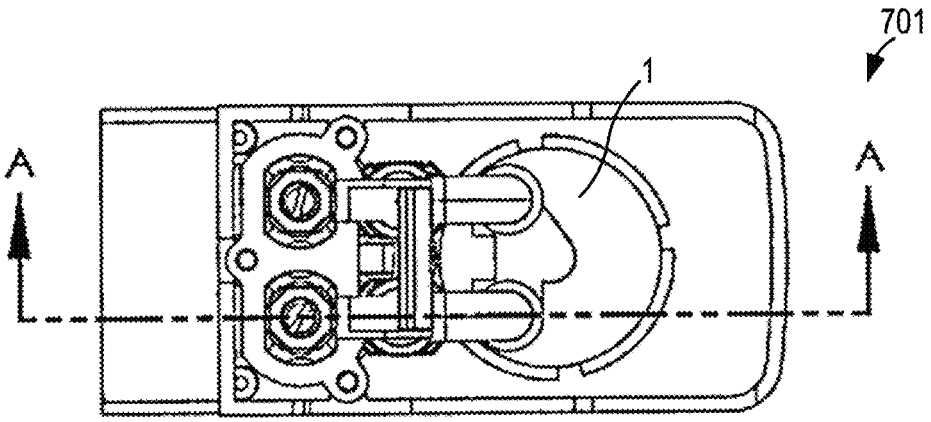
Figure 7E:
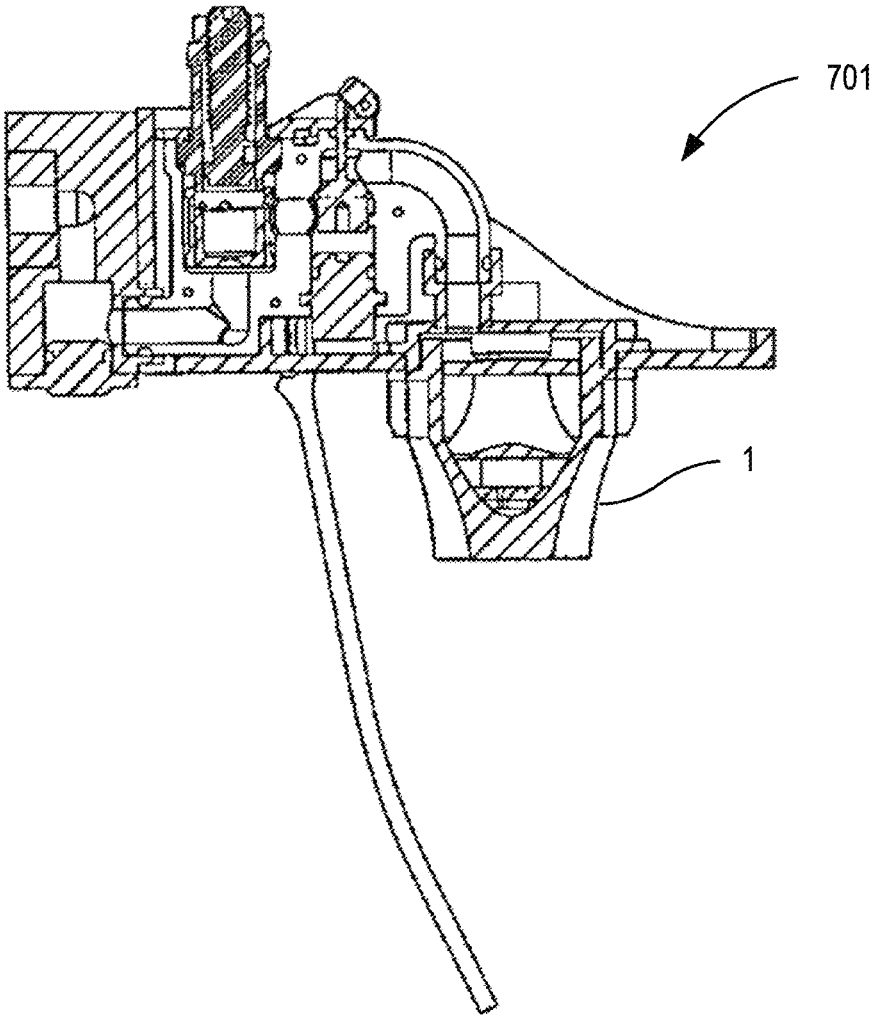
Figure 7F:
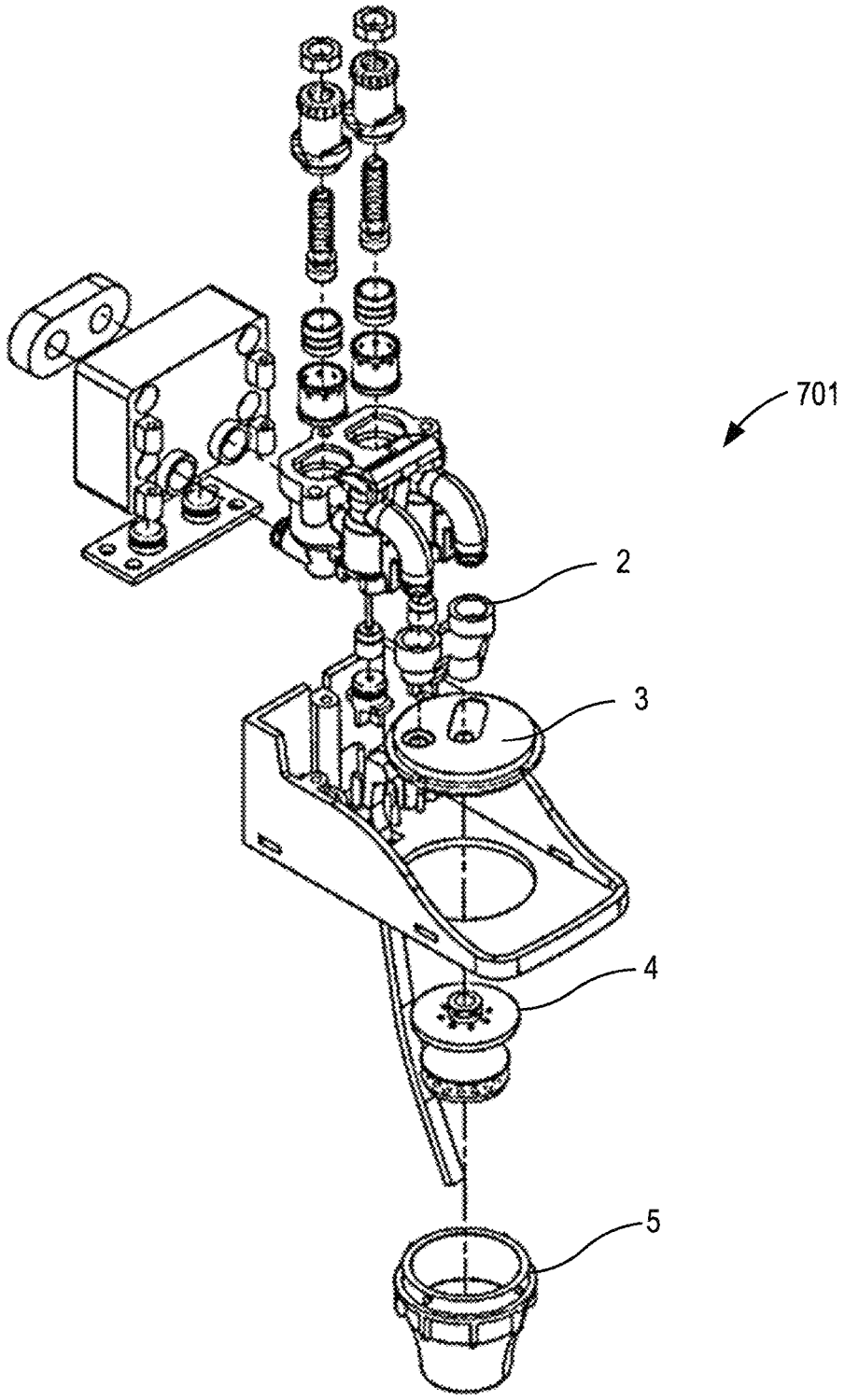

As shown in the cross-section of FIG. 6E the diameter of the inner surface 25 of the body 5 at the bottom of the conical portion 23 is larger than the diameter of the bottom of the conical portion 23 so that a ring gap 44 is defined between the two. The first flow path flows from the first middle chamber 41 through the ring gap 44 and into a second middle chamber 45. The width of the ring gap 44 may be between 0.04 inches and 0.1 inches, and preferably about 0.07 inches. The increased velocity in the lower portion 43 of the first middle chamber 41 further generates a uniform flow rate in all radial directions around the ring gap 44.

The second middle chamber 45 is defined by the bottom surface 30, the ring gap 44, the stem 46, the lower plate 22 and the inner surface 25 of the body 5. As shown in FIG. 6B, the second middle chamber 45 is toroid in shape with the central lumen 32 in the void/hole of the toroid. As shown in FIG. 6B, the ring gap may be greater in diameter than the circular pattern of through holes 28. This larger diameter has the advantage of further causing entering from the ring gap to be directed toward the central axis 8 in order to reach the through holes 28 which causes a uniform flow in all radial directions through the through holes 28. From the second middle chamber 45 the first flow path flows through all of the through holes 28 of the lower plate 22 and into a mixing chamber 47 defined by the lower plate 22, the inner surface 25 of the body 5 and the bottom opening 37 of the body 5.

The course of the first flow path causes a fluid entering the nozzle 1 at a position offset from the central axis 8, to be distributed around the central axis 8 and exit through the through holes 28 of the lower plate 22 with a substantially uniform flow rate in all radial directions around the central axis. Between the cap 3 and the lower plate 22 the first flow path surrounds and is fluidly separated from the central lumen 32.

The second flow path begins at the second input port 7 of the input fitting 2 and at the second input port 7 initially flows parallel to the central axis 8. From the second input port 7, the second flow path enters the second output port 10 and initially flows perpendicular to the central axis 8 and then flows coaxially with the central axis through the second through hole 18 of cap 3, as discussed above and shown by the curved arrow in FIG. 2E. As noted above, this serpentine path allows for the first and second input ports 7 and 9 to be positioned at mirror-image locations offset from the central axis 8 at the top of the nozzle assembly 1, while allowing the fluid entering the second input port to reach the central axis 8 and flow through the central lumen 32.

After passing through the second through hole 18 the second flow path enters and flows through the central lumen 32 of the insert 4 while being encircled by and fluidly separated from the first flow path. The second flow path then flows out of the outlets 35 in a radial pattern perpendicular to the central axis 8 into the mixing chamber 47.

In the mixing chamber 47 the flow of a first fluid flowing through the first flow path mixes with a second fluid flowing through the second flow path. Due to the uniform flow rates in the radial direction of both the first flow path and the second flow path in the mixing chamber, the ratio of first fluid to second fluid in all radial directions in the mixing chamber 47 is uniform. Additionally, the vertical flow of the first fluid flow path and the horizontal flow of the second fluid flow path lead to uniform mixing of the fluids caused by the perpendicular collision of the streams. The resulting output of the post-mixed beverage is uniform in flow rate and mixing ratio in all radial directions. In embodiments, the first fluid flowing through the first flow path may be a base fluid comprising water, carbonated water, or a mixture thereof. In embodiments, the second fluid flowing through the second flow path may be a mixer fluid such as one or more flavoring syrups, an alcohol fluid, or a mixture thereof. In embodiments, the flow paths and input fluids are configured to result in a desired output carbonation, cup foam height, and output temperature.

In embodiments, the components as disclosed above may be manufactured as one or more integral components. For example the cap 3 and input fitting 3 may be formed as one part. In embodiments, the components may be fitted together with adhesives, welding, threading, press fit, and combinations thereof. In embodiments, the components may formed for example by molding, additive manufacturing (e.g. 3D printing), and/or subtractive manufacturing (e.g. machining). In embodiments, the components may be made of plastic, metal, ceramic, and combinations thereof, and the components of the nozzle assembly 1 may be made of different or the same materials.

FIGS. 7A-7F show a post-mix beverage dispensing apparatus 701 including a dispensing nozzle assembly 1, as disclosed above.

Figure 8A:
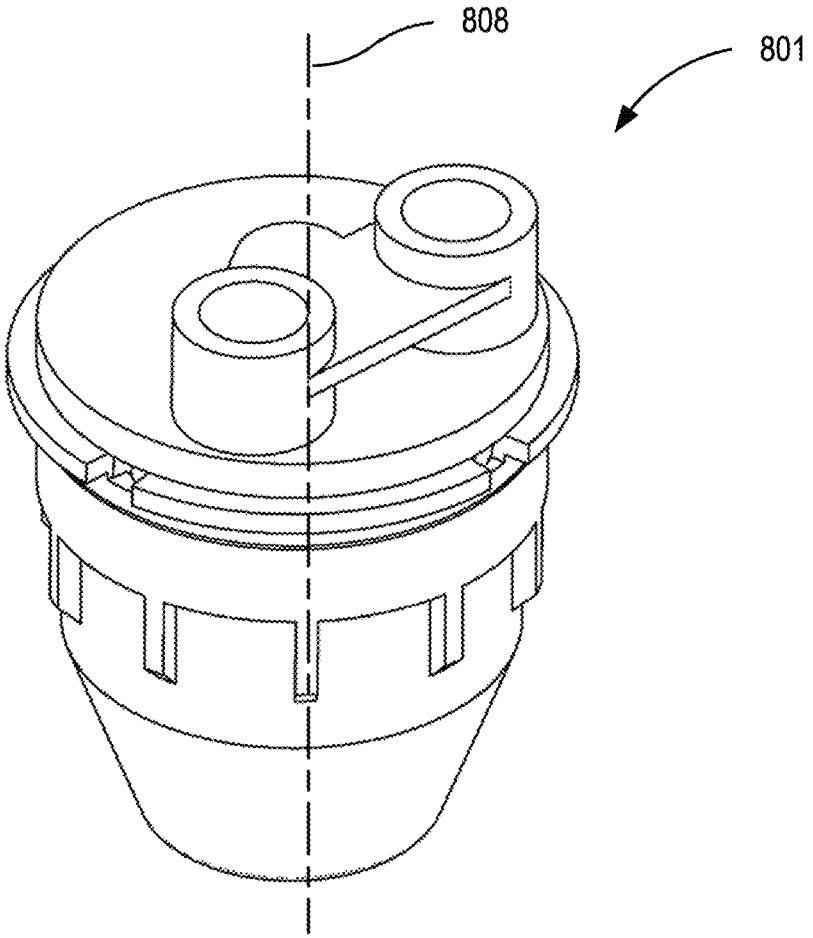
FIG. 8A shows a nozzle assembly according to embodiments of the disclosed technology.
Figure 8B:
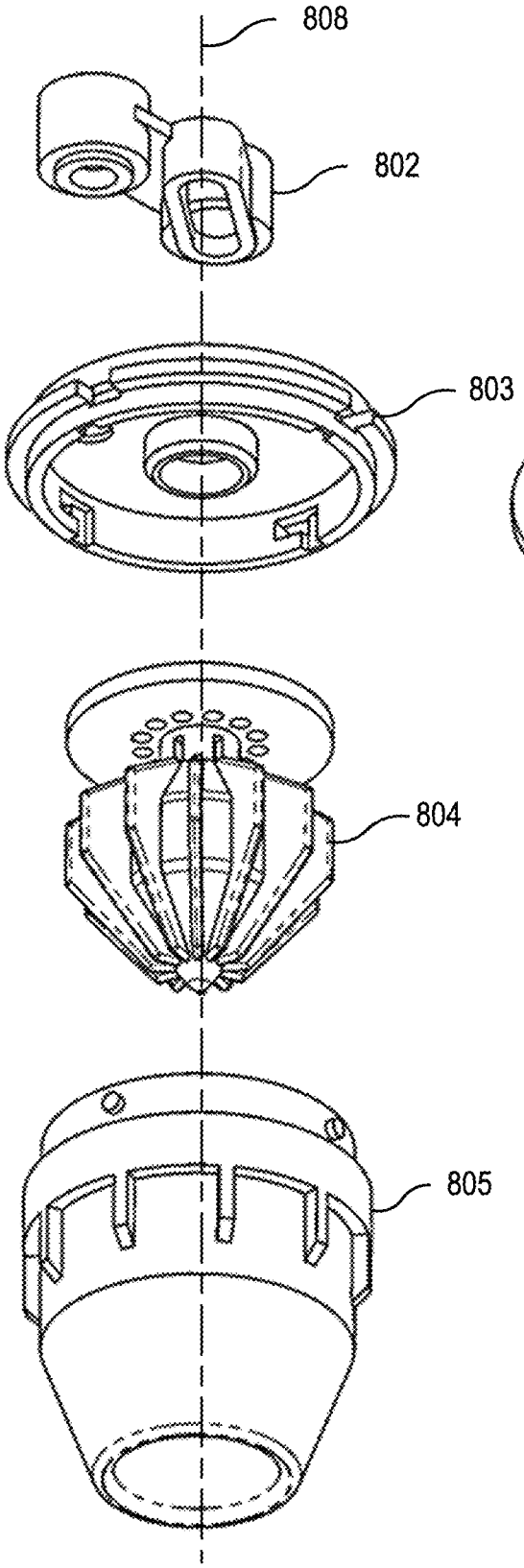
FIGS. 8B and 8C show exploded views of the nozzle assembly of FIG. 8A. according to embodiments of the disclosed technology.
Figure 8C:
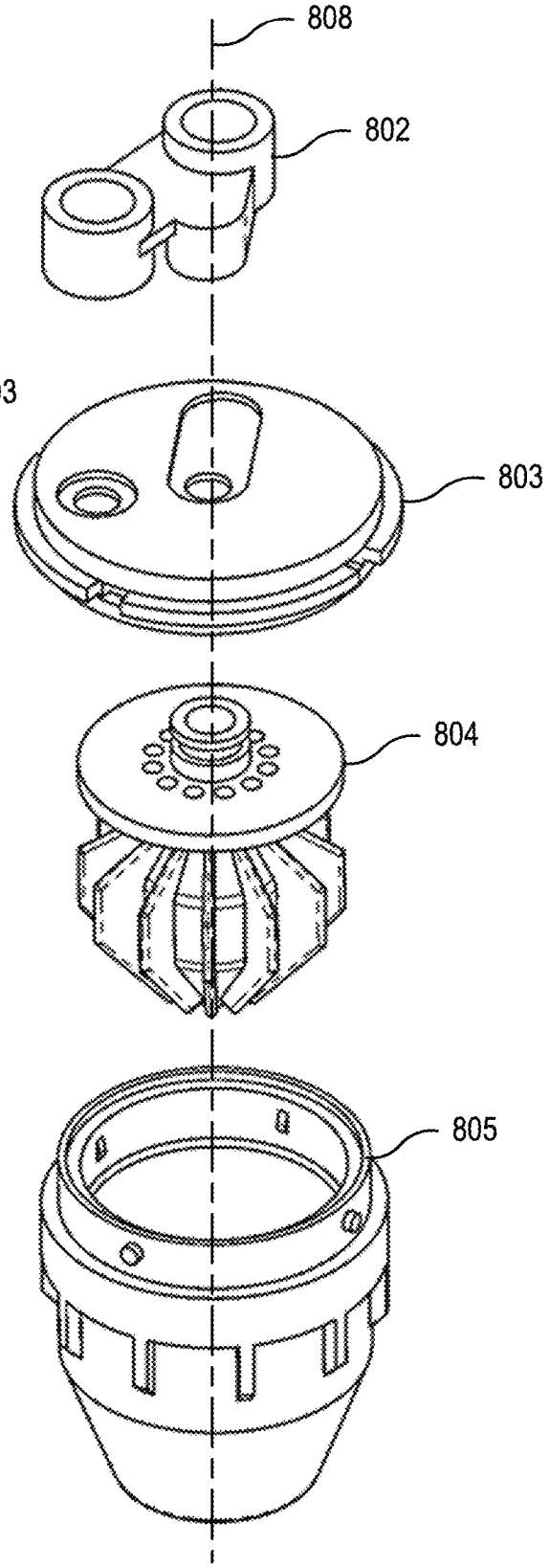

FIG. 8A shows an embodiment of a nozzle assembly 801 similar to the nozzle assembly of FIG. 1A. FIGS. 8B and 8C show exploded views of the nozzle assembly 801 of FIG. 8A. As shown, the nozzle assembly 801 includes an input fitting 802 shown in more detail in FIGS. 9A-9G, a cap 803 shown in more detail in FIGS. 10A-10E, an insert 804 shown in more detail in FIGS. 11A-11F, and a body 805 shown in more detail in FIGS. 12A-12C.

FIGS. 9A-9G show an input fitting 802. The input fitting 802 includes a first input port 806 and a second input port 807. As will be discussed in greater detail below, the first input port 806 and the second input port 807 are radially offset from the central axis 808 of the nozzle assembly 801. As shown, the first input port 806 and the second input port 807 may be circular and are sized and shaped to couple to fluid conduits connected to fluid sources.

Figure 9A:
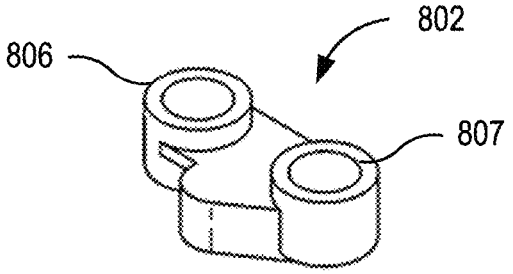
FIGS. 9A-9G show an input fitting according to embodiments of the disclosed technology.
Figure 9B:
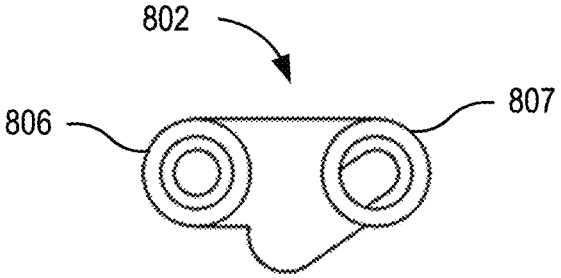
Figure 9C:
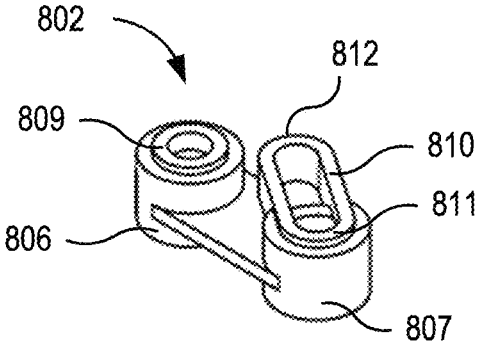
Figure 9D:
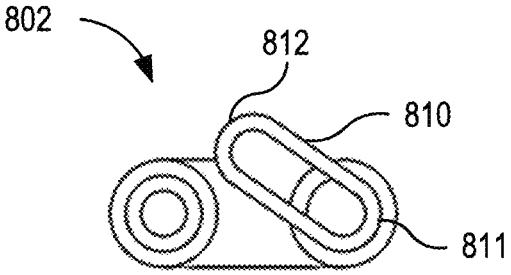
Figure 9E:
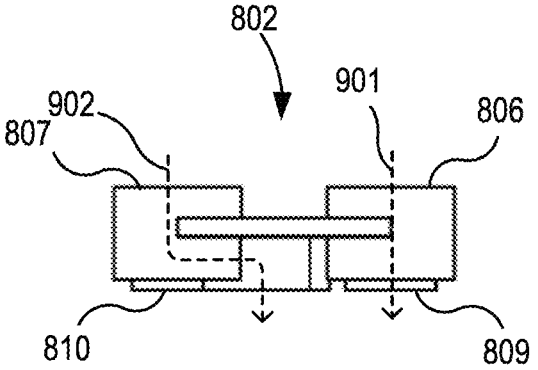
Figure 9F:
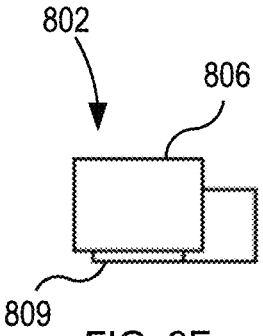
Figure 9G:
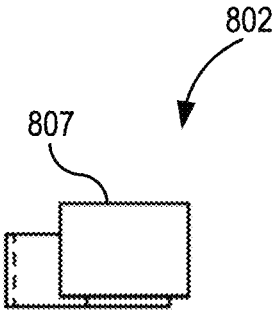

Input fitting 802 further includes a first output port 809. First output port 809 may be circular as shown in FIGS. 9C and 9D. First input port 806 and first output port 809 are coaxial and fluidly connected to define a portion of a first flow path. The portion of the first flow path defined by the first input port 806 and the first output port 809 is generally straight so that a first liquid can flow straight through the input fitting, as indicated by the straight line arrow 901 of FIG. 9E. Input fitting 802 further includes a second output port 810. Second output port 810 may be elongated in shape with circular ends as shown in FIGS. 9C and 9D. A first end 811 of the second output port 810 is aligned with second input port 807. A second end 812 of the second the output port 810 is not aligned with second input port 807, and as will be discussed in greater detail below is positioned so that when the input fitting 802 is coupled to the cap 803 as part of the nozzle assembly 801 the central axis 808 extends through the second end 812 of the second output port 810. The second input port 807 and the second output port 810 are connected to define a portion of a second flow path, along with the cap 803 as will be discussed below. The portion of the second flow path is serpentine in shape from the second input port 807, to the first end 811 of the second output port 810, to the second end 812 of the second output port 810. The portion of the second flow path allows for a second liquid to flow through the input fitting, as indicated by the S shaped arrow 902 of FIG. 9E. In embodiments, the input fitting 802 is formed as a single component, or as two or more components, for example a first component with the first input and output ports, and a second component with the second input port and the second output port.

FIGS. 10A-10E show a cap 803. Cap 803 includes a top surface 813 that defines a portion of an outer surface of the nozzle assembly 801, and a bottom surface 814 that defines a portion of an inner surface of the nozzle assembly 801. Top surface 813 includes a first recess 815 and a second recess 816. First recess 815 is generally circular and is sized and shaped to receive and couple to the first output port 809 of the input fitting 802. The second recess 816 is elongated in shape with rounded ends and is sized and shaped to receive and couple to the second output port 810 of the input fitting 802. The second recess 816 extends from the center of the cap 803, which corresponds to the central axis 808 of the nozzle assembly 801, toward a perimeter of the cap 803. The first recess 815 include a first through hole 817 concentric with the first recess 815. The second recess 816 includes a second through hole 818 at the center of the cap 803. With the input fitting 802 coupled to the cap 803 a portion of the first flow path is defined from the first input port 806 through the first through hole 817, and a portion of the second flow path is defined from the second input port 807 through the second through hole 818. In embodiments, the surface of the second recess defines an inner surface of the second flow path.

Figure 10A:
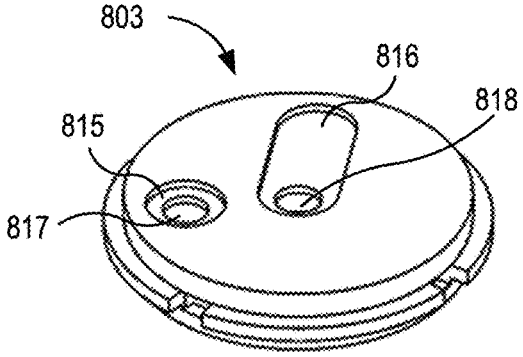
FIGS. 10A-10E show a cap according to embodiments of the disclosed technology.
Figure 10D:
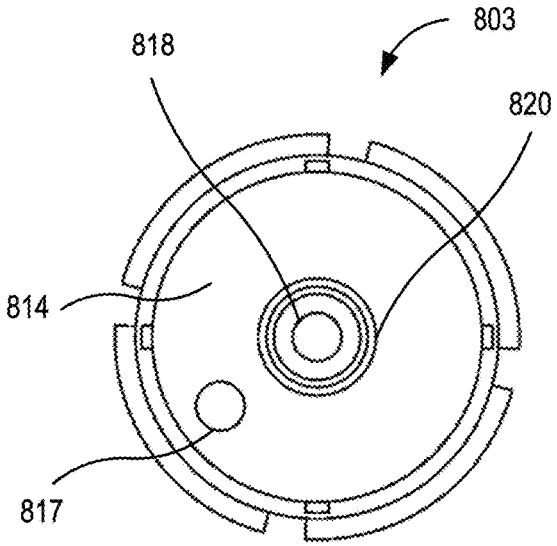
Figure 10B:
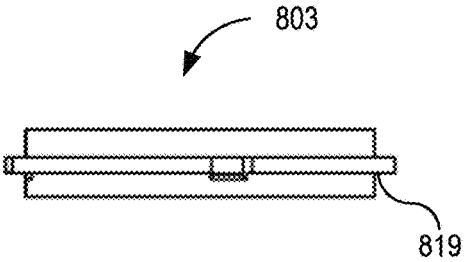
Figure 10C:
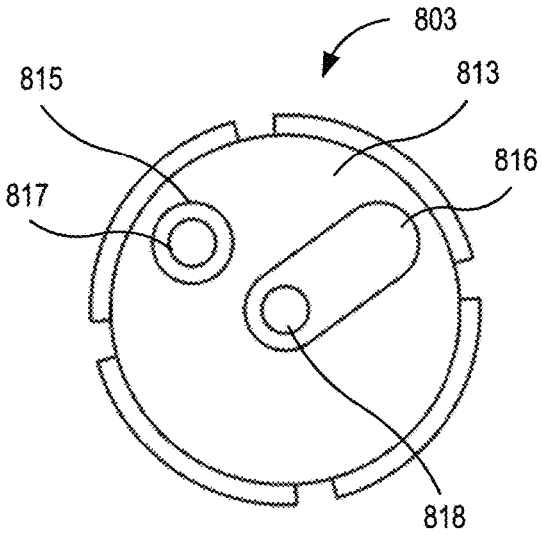
Figure 10E:
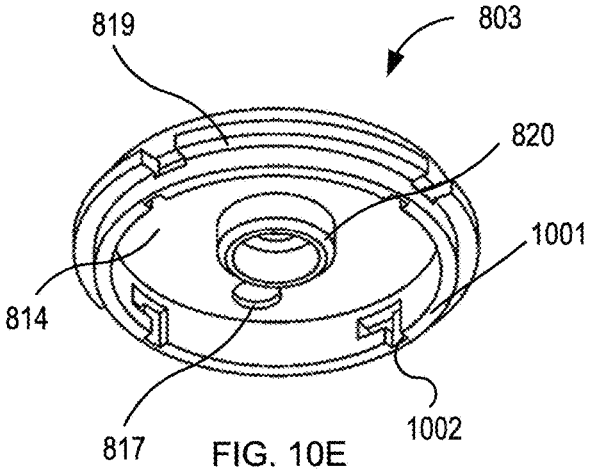

As shown in FIG. 10E, cap 803 further includes a bottom surface 814 surrounded by a flange 819. Extending downwardly from the bottom surface 814 is a coupling ring 820 in the center of the bottom surface 814. Coupling ring 820 surrounds the second through hole 818 and is shaped and sized to couple to the insert 804, as will be discussed in greater detail below. Cap 803 further comprises a outer coupling ring 1001 extending downwardly from flange 819. Outer coupling ring 1001 is circular and shaped and sized to be receiving within body 805. Outer coupling ring 1001 defines locking 1002 tracks which received locking tabs 1201 of the body 805 in order to couple the body to the cap. The locking tracks 1002 are L-shaped. To couple the body 805 to the cap 803 the outer coupling ring 1001 is inserted into the body 805 with the locking tabs 1201 positioned within the vertical portion of the L-shaped locking tracks 1002, the cap 803 is then rotated relative to the body 805 so that the locking tabs 1201 translate along the horizontal portion of the L-shaped locking in order to prevent vertical movement of the cap relative to the body.

Figure 11A:
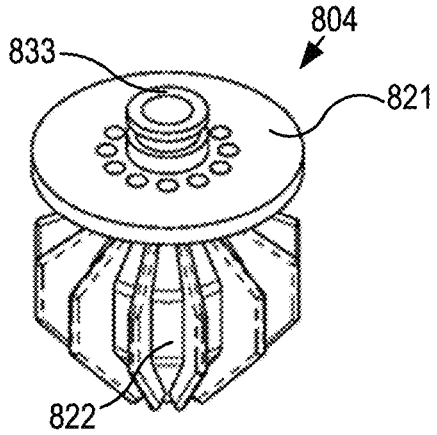
FIGS. 11A-11F show an insert according to embodiments of the disclosed technology.
Figure 11B:
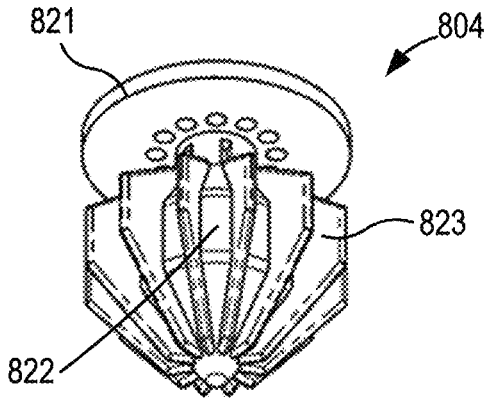
Figure 11C:
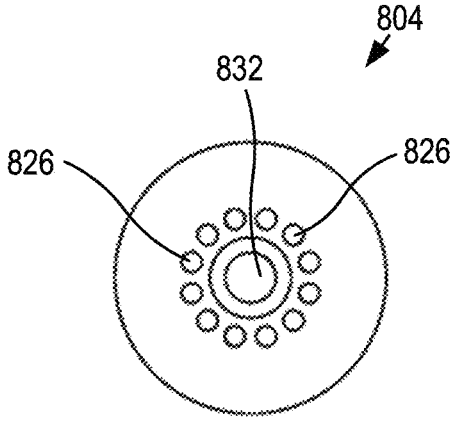

FIGS. 11A-11F show insert 804. As shown in FIG. 11A, insert 804 includes an upper plate 821, a lower core portion 822, and a plurality of fins 823. Upper plate 821 is generally circular with an outer edge 824 shaped and angled to form a flush seal against the inner surface 825 of the body 805. Upper plate 821 further includes a plurality of through holes 826. For clarity in the figures only a portion of the through holes 826 are indicated with reference numerals and lead lines. As shown in FIG. 11C the through holes 826 may be positioned along a single circular pattern, which is around the central axis 808 of the nozzle assembly 801. In the embodiment shown, the through holes 826 of the upper plate 821 include eight equally spaced through holes. However, other numbers and patterns of through holes 826 may be included. In embodiments, the through holes 826 have diameter in the range of 0.05 inches and 0.12 inches, and preferably 0.08 inches.

Figure 11D:
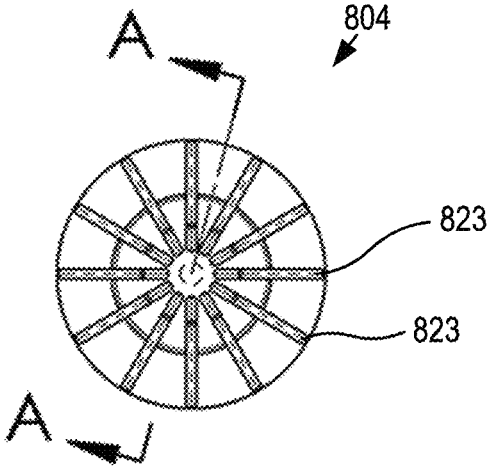
Figure 11E:
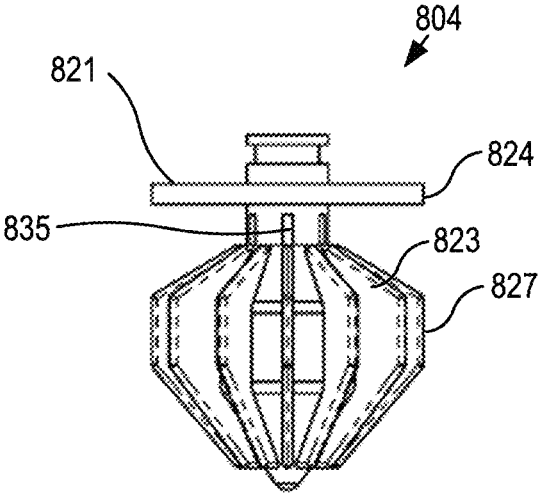
Figure 11F:
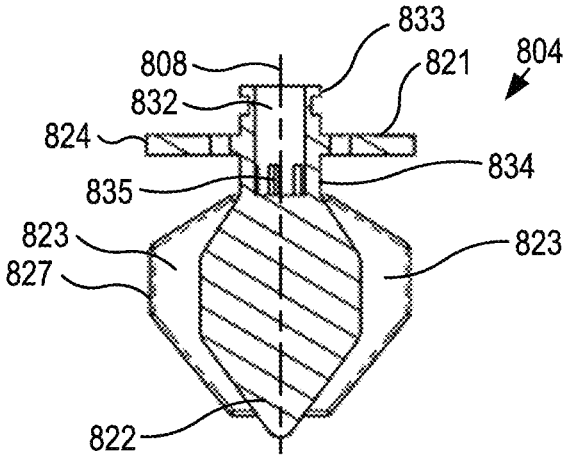
Figure 13A:
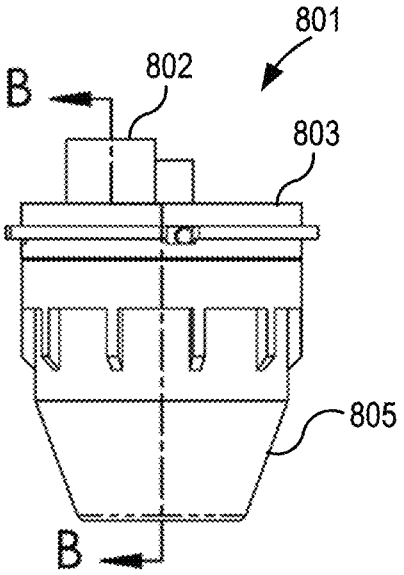
FIGS. 13A-13F show a nozzle assembly according to embodiments of the disclosed technology.
Figure 13B:
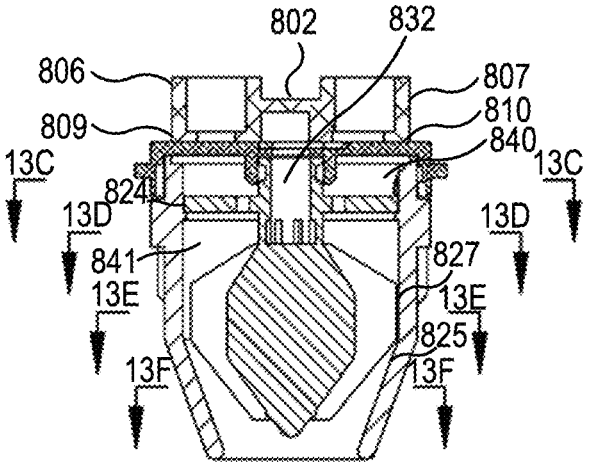
Figure 13C:
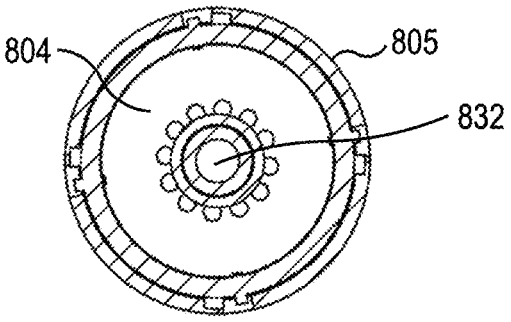

As shown in FIG. 11F, lower core portion 822 has a tapered upper portion, a cylindrical center portion, and a tapered lower portion. A plurality of vanes 823 extend radially from the lower core portion 822. As shown in FIG. 11D the insert 804 includes 12 vanes, however inserts may include other numbers of vanes. The vanes 823 are generally trapezoidal in shape including an upper angle edge facing the upper plate 821, a lower angled edged facing away from the upper plate 821, and a straight edge 827 parallel to the center axis 808 and shaped and angled to contact the inner surface 825 of the body 805, as shown in FIGS. 13B and 13E. The arrangement of vanes 823 causes substantially uniform flow in all radial directions of a mixed fluid passing through the vanes from upstream of the vanes from the first and second flow paths.

The insert 804 further defines a central lumen 832 extending from a coupling 833 at the top of the insert 804 above the upper plate 821, through the upper plate 821, and to an outlet region 834, adjacent to the upper portion of the lower core portion 822. As shown in FIG. 11C, the central lumen 832 is generally circular in profile. The central lumen 832 is open at the coupling 833. Coupling 833 is shaped and sized to couple with the coupling ring 820 of the cap 803 to form a watertight seal. The outlet region 834 at the bottom of the central lumen 833 defines a plurality of outlets 835. As shown, the outlets 835 may be rectangular in profile and are oriented to direct a fluid stream flowing into the central lumen 832 from the coupling 833 out in a radial pattern in an exit plane perpendicular to the central axis 808.

Figure 12A:
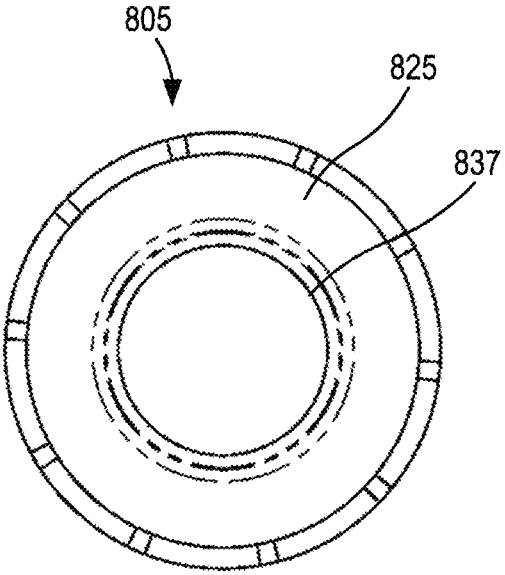
FIGS. 12A-12C show a body according to embodiments of the disclosed technology.
Figure 12B:
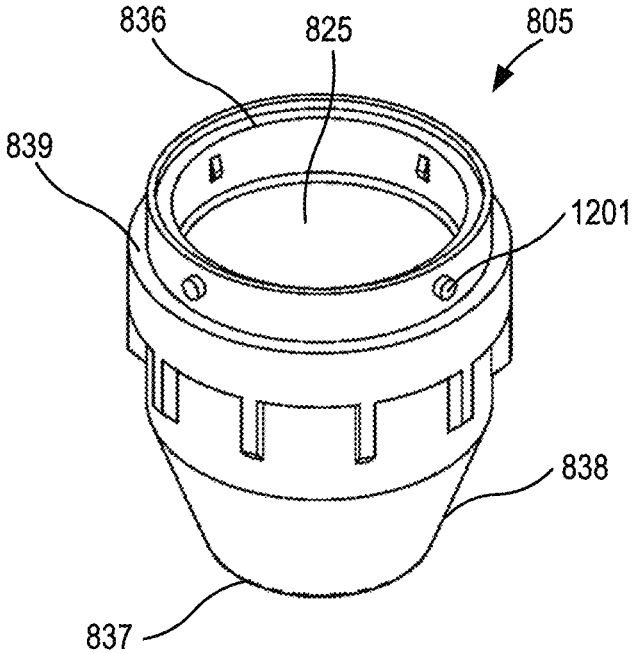
Figure 12C:
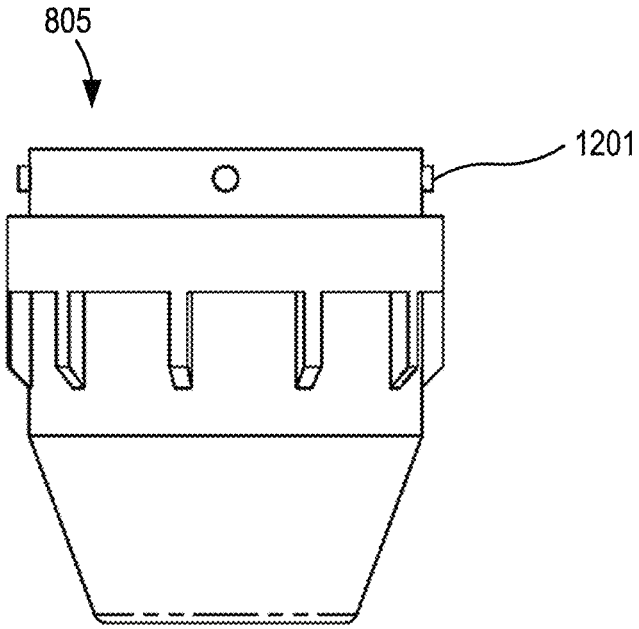

FIGS. 12A-12C show body 805. Body 805 includes a top opening 836 and a bottom opening 837 on opposite ends of the inner surface 825. As shown, top opening 836 may be smaller than bottom opening 837 so that the inner surface 825 tapers from the top to the bottom of the body 805. The taper of the inner surface 825 may be a curved taper. In embodiments the taper may be straight. The taper of the inner surface 825 defines an axial position where the insert 804 will be positioned and form a seal. The body further comprises an outer surface 838. At the top of the body 805, the outer surface 838 includes a flange 839 sized and shaped to form a seal with the flange 819 of the cap 803. When flange 839 and flange 819 couple and seal the interior of the body 805 and cap 803 define a watertight compartment with through holes 817 and 818 defining inlets and bottom opening 837 defining an outlet.

Figure 13D:
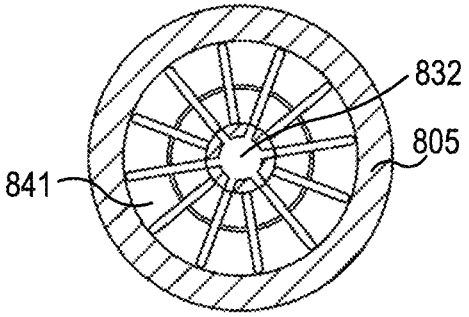
Figure 13E:
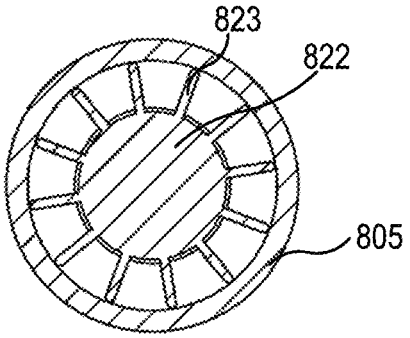
Figure 13F:
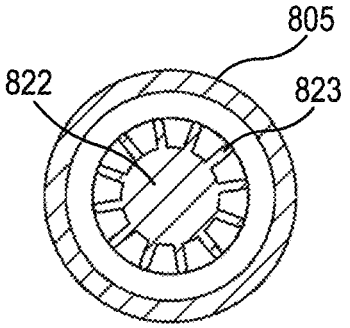
Figure 14A:
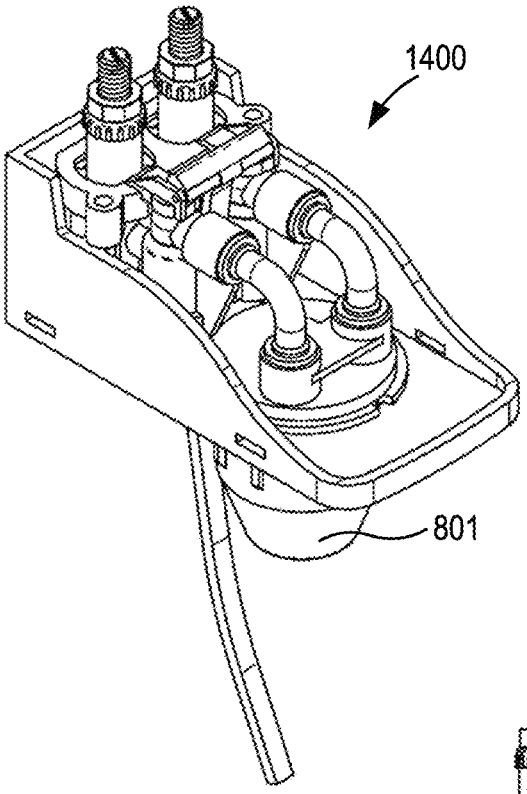
FIGS. 14A-14F show a post-mix beverage dispensing apparatus including a dispensing nozzle of FIG. 8A
Figure 14B:
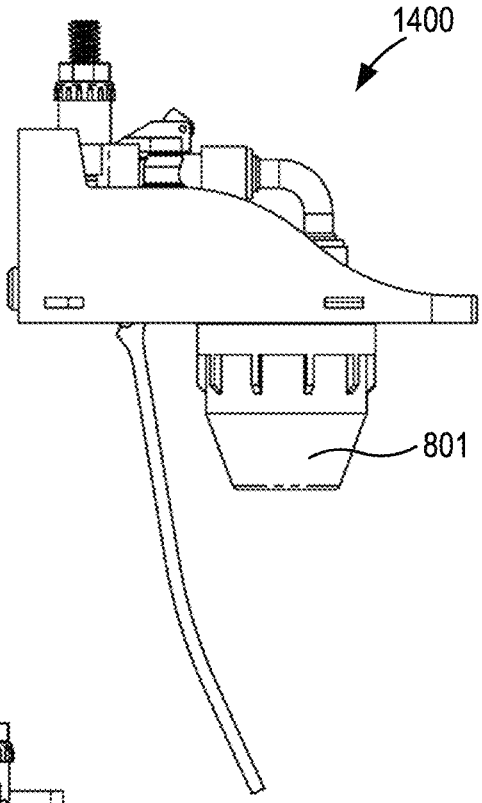
Figure 14C:
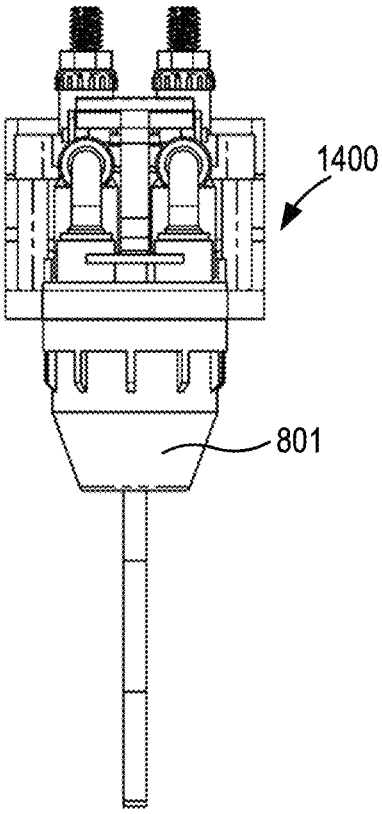
Figure 14D:
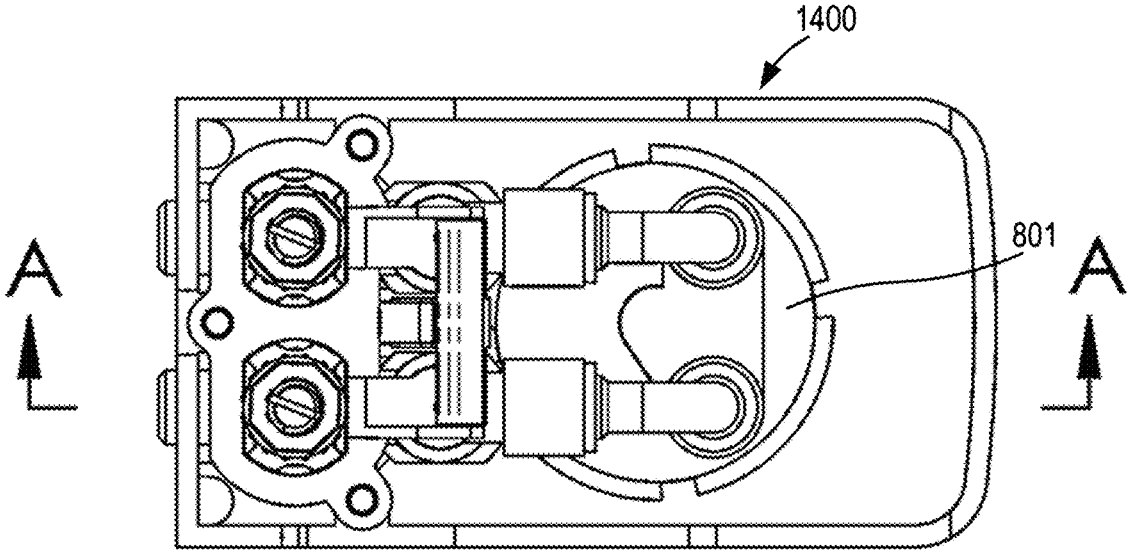
Figure 14E:
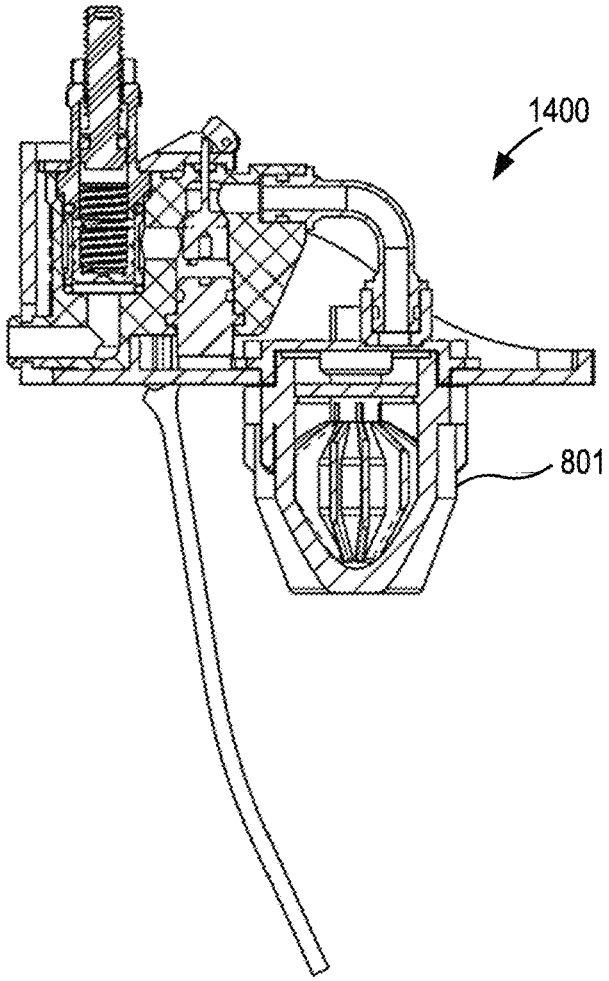
Figure 14F:
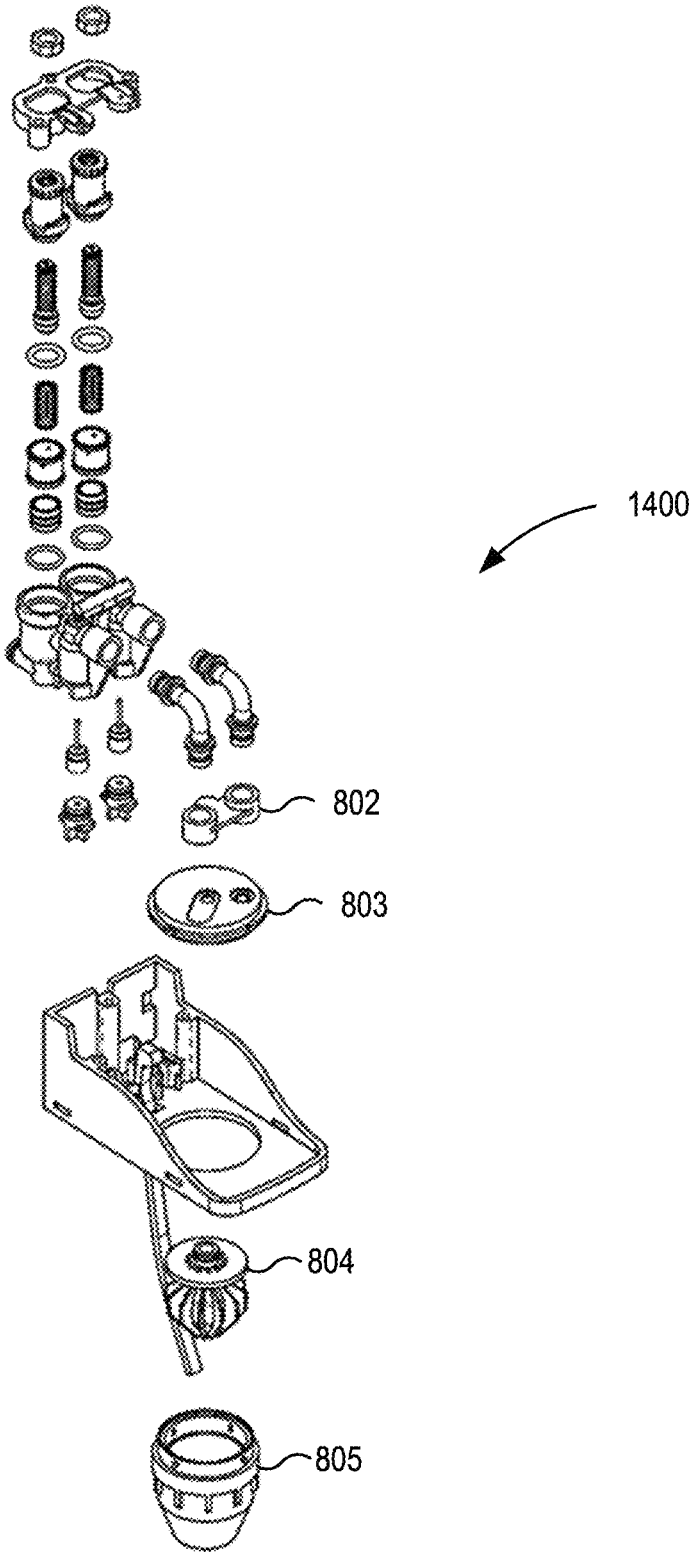

FIGS. 13A-13F shows various cross-sectional views of the nozzle assembly of FIG. 8A. As shown, in the assembled configuration the insert 804 comprising the plurality of vanes 823 defines internal radial flow paths with the body. The internal radial flow paths have wide top sections, narrower middle sections, and wide bottom sections due to the shape of the lower core portion 822. As noted above, the lower core portion core of the insert, from which the vanes extend, is wider in a middle portion than the top and bottom portions, as shown in FIGS. 13D-13F. The nozzle assembly 801 defines a first flow path for a first beverage component from a first input port radially offset from a central vertical axis of the nozzle, into a chamber where the first fluid is dispersed radially around the central vertical axis, then through holes in a plate into a mixing chamber. A second flow path for a second beverage component is defined to flow from a second input port aligned with the central vertical axis and through a lumen into the mixing chamber. Similar to the nozzle assembly of FIG. 1A, a portion of the first flow path within the body is separate from and surrounds a portion of the second flow path within the body. In the mixing chamber the first and second beverage components initially mix. From the mixing chamber the initial mixture further mixes as it flows through the internal radial flow paths and out the outlet end of the nozzle. FIGS. 14A-14F show a post-mix beverage dispensing apparatus 1400 including a dispensing nozzle 801 of FIG. 8A.

Specifically, as shown in FIGS. 13A-13F a nozzle assembly 801 includes an input fitting 802, a cap 803, an insert 804, and a body 805, as disclosed above. As shown in the cross-section view of FIG. 13B, insert 804 is positioned in the body 805 so that upper plate 821 forms a seal with inner surface 825, and vanes 823 contact inner surface 825. Further, as shown in FIG. 13B the taper of inner surface 825 at vanes 823 prevents insert 804 from being positioned lower in body 805. With this positioning of insert 804, the coupling 833 is located substantially in the plane of the top opening 836 of the body 805 so that when the cap 803 couples to the body 805 the coupling ring 820 couples to and forms a seal with coupling 833.

The nozzle assembly 801 defines two flow paths, a first flow path and a second flow path. The first flow path begins at the first input port 806 of the input fitting 802 and flows parallel to the central axis 808 through the first output port 809, through the first through hole 817 of cap 803, and into an upper chamber 840 defined by the inner surface 825 of the body 805, the cap 803, and the upper plate 821 of the insert 804. As shown in FIG. 13B the outer edge 824 of the upper plate 821 seals with the inner surface 825 of the body 805. Further, as shown in FIG. 13B and the cross-section of FIG. 13C the upper chamber 840 is a toroid in shape with the central lumen 832 in the void/hole of the toroid. When fluid enters the upper chamber 840 from the first input port 806 the fluid substantially occupies the entire volume of the upper chamber 840.

From the upper chamber 840 the first flow path flows through all of the through holes 826 of the upper plate 821 and into a middle chamber 841. The middle chamber 841 is defined by the upper plate 822, the inner surface 825 of the body 805, the vanes 823 and the lower core portion 822. As shown in FIG. 13B and the cross-sections of FIGS. 13D and 13E, the middle chamber 841 is toroidal in shape with the central lumen 32 in the void/hole of the toroid. As shown, an upper portion of the middle chamber 841 has a larger cross sectional area than a bottom portion due to the tapering of the lower core portion 822. As fluid passes through the middle chamber 841 the velocity increases due to this reduction in cross-sectional area.

The course of the first flow path causes a fluid entering the nozzle 801 at a position offset from the central axis 808, to be distributed around the central axis 808 and pass through the through holes 826 with a substantially uniform flow rate in all radial directions around the central axis.

The second flow path begins at the second input port 807 of the input fitting 802 and at the second input port 807 initially flows parallel to the central axis 8. From the second input port 807, the second flow path enters the second output port 810 and initially flows perpendicular to the central axis 808 and then flows coaxially with the central axis through the second through hole 818 of cap 803, as discussed above and shown by the curved arrow in FIG. 9E. As noted above, this serpentine path allows for the first and second input ports 807 and 809 to be positioned at mirror-image locations offset from the central axis 808 at the top of the nozzle assembly 801, while allowing the fluid entering the second input port to reach the central axis 808 and flow through the central lumen 832.

After passing through the second through hole 818 the second flow path enters and flows through the central lumen 832 of the insert 804 while being encircled by and fluidly separated from the first flow path. The second flow path then flows out of the outlets 835 in a radial pattern perpendicular to the central axis 808 into the upper chamber 840.

In the upper chamber 840 the flow of a first fluid flowing through the first flow path mixes with a second fluid flowing through the second flow path. Due to the uniform flow rates in the radial direction of both the first flow path and the second flow path in the upper chamber 840, the ratio of first fluid to second fluid in all radial directions in the upper chamber 840 is uniform. Additionally, the vertical flow of the first fluid flow path and the horizontal flow of the second fluid flow path lead to uniform mixing of the fluids caused by the perpendicular collision of the streams. The resulting output of the post-mixed beverage is uniform in flow rate and mixing ratio in all radial directions. In embodiments, the first fluid flowing through the first flow path may be a base fluid comprising water, carbonated water, or a mixture thereof. In embodiments, the second fluid flowing through the second flow path may be a mixer fluid such as one or more flavoring syrups, an alcohol fluid, or a mixture thereof. In embodiments, the flow paths and input fluids are configured to result in a desired output carbonation, cup foam height, and output temperature.

In embodiments, the components as disclosed above may be manufactured as one or more integral components. For example the cap 803 and input fitting 803 may be formed as one part. In embodiments, the components may be fitted together with adhesives, welding, threading, press fit, and combinations thereof. In embodiments, the components may formed for example by molding, additive manufacturing (e.g. 3D printing), and/or subtractive manufacturing (e.g. machining). In embodiments, the components may be made of plastic, metal, ceramic, and combinations thereof, and the components of the nozzle assembly 801 may be made of different or the same materials.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

While the above description describes various embodiments of the invention and the best mode contemplated, regardless how detailed the above text, the invention can be practiced in many ways. Details of the system may vary considerably in its specific implementation, while still being encompassed by the present disclosure. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples; alternative implementations may employ differing values or ranges, and can accommodate various increments and gradients of values within and at the boundaries of such ranges.

What is claimed is:

1. A post-mix beverage dispensing nozzle, comprising:

a body comprising a top opening, a bottom opening opposite the top opening, a central vertical axis extending between the top opening and bottom opening, and an inner surface extending between the top opening and the bottom opening and surrounding the central vertical axis;

a first input port disposed at the top opening and radially offset from the central vertical axis;

a second input port disposed at the top opening and radially offset from the central axis; and an insert within the body, wherein the insert comprises a conical portion, an upper plate positioned between the conical portion and the top opening, and a lower plate positioned between the conical portion and the bottom opening;

wherein a first flow path for a first beverage component is defined to flow from the first input port, through the body, and out the bottom opening, wherein a second flow path for a second beverage component is defined to flow from the second input port, through the body coincident to the central axis, and out the bottom opening, wherein a portion of the first flow path within the body is separate from and surrounds a portion of the second flow path within the body, wherein the first flow path and the second flow path are configured so that the first beverage component and the second beverage component mix prior to exiting the bottom opening, wherein the first flow path flows from the first input port into an upper chamber defined by the inner surface and the upper plate, wherein the first flow path flows from the upper chamber to a first middle chamber defined by the inner surface, the upper plate, and an a conical surface of the conical portion, wherein the first flow path flows from the first middle chamber to a second middle chamber defined by the inner surface, the lower plate and a bottom surface of the conical portion, wherein the first flow path flows from the second middle chamber to a mixing chamber defined by the inner surface, the lower plate and the bottom opening, wherein the conical portion defines a lumen coincident to the central axis and defining a portion of the second flow path, and wherein the second flow path flows from the second input port, through the lumen, and into the mixing chamber.

2. The post-mix beverage dispensing nozzle of claim 1, wherein the upper chamber is substantially a toroid in shape, and wherein the second flow path flows through a hole of the toroid of the upper chamber.

3. The post-mix beverage dispensing nozzle of claim 1, wherein the upper plate comprises a plurality of first through holes in a circular pattern around the central vertical axis and defining a portion of the first flow path between the upper chamber and the first middle chamber.

4. The post-mix beverage dispensing nozzle of claim 1, wherein the conical surface of the conical portion is frusto-conical in shape, and wherein a downstream cross-section of the first flow path in the first middle chamber is smaller than an upstream cross-section of the first flow path in the first middle chamber.

5. The post-mix beverage dispensing nozzle of claim 4, wherein a ring gap is defined between a lower portion of the conical portion and the inner surface of the body, and wherein the first flow path flows from the first middle chamber through the ring gap to the second middle chamber.

6. The post-mix beverage dispensing nozzle of claim 4, wherein the conical surface of the conical portion is concave in a cross-sectional plane parallel to the central axis.

7. The post-mix beverage dispensing nozzle of claim 1, wherein the second middle chamber is substantially a toroid in shape, and wherein the second flow path flows through a hole of the toroid of the second middle chamber.

8. The post-mix beverage dispensing nozzle of claim 1, wherein the lower plate comprises a plurality of second through holes in a circular pattern around the central axis and define a portion of the first flow path from the second middle chamber to the mixing chamber.

9. The post-mix beverage dispensing nozzle of claim 8, further comprising an outlet nozzle within the mixing chamber, wherein the second flow path flows from the lumen of the conical portion to the outlet nozzle and into the mixing chamber to mix with the first flow path.

10. The post-mix beverage dispensing nozzle of claim 9, wherein the outlet nozzle comprises a plurality of outlets, wherein the plurality of outlets direct the second flow path in a plurality of directions radially from the central axis.

* * * * *